US010081508B2

(12) United States Patent
Kato et al.

(10) Patent No.: US 10,081,508 B2
(45) Date of Patent: Sep. 25, 2018

(54) SHEET FEEDER, DOCUMENT READER, AND IMAGE FORMING APPARATUS

(71) Applicant: KONICA MINOLTA, INC., Chiyoda-ku (KR)

(72) Inventors: Takaki Kato, Toyokawa (JP); Yuji Kobayashi, Toyohashi (JP); Yuta Tachibana, Toyokawa (JP); Hiroshi Yamaguchi, Toyokawa (JP); Satoshi Teshima, Okazaki (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 14/337,416

(22) Filed: Jul. 22, 2014

(65) Prior Publication Data

US 2015/0028533 A1 Jan. 29, 2015

(30) Foreign Application Priority Data

Jul. 24, 2013 (JP) ..... 2013-153779

(51) Int. Cl.
*B65H 7/14* (2006.01)
*B65H 3/06* (2006.01)

(52) U.S. Cl.
CPC ..... *B65H 7/14* (2013.01); *B65H 3/0607* (2013.01); *B65H 2511/22* (2013.01);
(Continued)

(58) Field of Classification Search
CPC ... B65H 7/02; B65H 7/06; B65H 7/12; B65H 7/125; B65H 7/14; B65H 7/18;
(Continued)

(56) References Cited

U.S. PATENT DOCUMENTS 4,540,887 A * 9/1985 Minerd et al. ..... 250/559.4
4,893,804 A * 1/1990 Sasage et al. ..... 271/3.09
(Continued)

FOREIGN PATENT DOCUMENTS

JP 2007-003736 A 1/2007
JP 2008-037583 A 2/2008
(Continued)

OTHER PUBLICATIONS

Decision to Grant a Patent issued in corresponding Japanese Patent Application No. 2013-153779, dated Apr. 28, 2015, and English translation thereof.
(Continued)

*Primary Examiner* — Ernesto A Suarez
(74) *Attorney, Agent, or Firm* — Buchanan Ingersoll & Rooney PC

(57) ABSTRACT

A sheet feeder picking up and transporting sheets includes a transport unit transporting sheets along a sheet transport path one by one, a gap occurrence detection unit detecting, within a predetermined section of the sheet transport path, occurrence of a gap between sheets, and a controller controlling a timing of the transport of sheets according to a result of the detection. The gap occurrence detection unit includes a first detection unit and a second detection unit. The first detection unit is configured to detect light that is emitted toward the predetermined section, reaches a converging surface thereof across the predetermined section, and converged on a receiving element thereof. The second detection unit is configured to detect light reflected by a sheet passing through the predetermined section. The occurrence of the gap is detected based on outputs from the first detection unit and the second detection unit.

11 Claims, 16 Drawing Sheets

(52) U.S. Cl.
CPC .. *B65H 2513/514* (2013.01); *B65H 2553/414* (2013.01); *B65H 2553/44* (2013.01); *B65H 2701/1311* (2013.01); *B65H 2701/1313* (2013.01); *B65H 2801/06* (2013.01)

(58) Field of Classification Search
CPC .... B65H 2301/351; B65H 2301/44514; B65H 2301/44516; B65H 2301/4452; B65H 2301/44522; B65H 2553/41; B65H 2553/412; B65H 2553/414; B65H 2553/416
See application file for complete search history.

(56) References Cited

U.S. PATENT DOCUMENTS

| | | | | |
|---|---|---|---|---|
| 5,139,339 | A * | 8/1992 | Courtney et al. | 356/446 |
| 5,262,637 | A * | 11/1993 | Cumberledge et al. | 250/223 R |
| 5,443,359 | A * | 8/1995 | Miller et al. | 414/798.9 |
| 5,608,207 | A * | 3/1997 | Allen et al. | 250/214 AG |
| 5,652,943 | A * | 7/1997 | Matsuo | B65H 5/00 399/21 |
| 6,554,275 | B1 * | 4/2003 | Tranquilla | 271/259 |
| 6,794,633 | B2 * | 9/2004 | Iwasaki | B65H 7/14 250/221 |
| 7,654,525 | B2 * | 2/2010 | Wang | 271/265.01 |
| 2003/0025090 | A1 | 2/2003 | Iwasaki | |
| 2006/0232759 | A1 | 10/2006 | Fukube et al. | |
| 2008/0030809 | A1 | 2/2008 | Itabashi et al. | |
| 2010/0044950 | A1 * | 2/2010 | Katsura | G03G 15/6579 271/10.03 |

FOREIGN PATENT DOCUMENTS

| | | |
|---|---|---|
| JP | 2012-236684 A | 12/2012 |
| JP | 2014-201366 | 10/2014 |

OTHER PUBLICATIONS

First Office Action dated Mar. 3, 2016 issued in the corresponding Chinese Patent Application No. 201410355464.4 and English translation (23 pages).

* cited by examiner

SHEET FEEDER, DOCUMENT READER, AND IMAGE FORMING APPARATUS

This application is based on an application No. 2013-153779 filed in Japan, the contents of which are hereby incorporated by reference.

BACKGROUND OF THE INVENTION (1) Field of the Invention

The present invention relates to a sheet feeder and also to a document reader and an image forming apparatus each having the sheet feeder.

(2) Related Art

An electrophotographic image forming apparatus forms an image by transferring a toner image formed on a surface of a photoreceptor to a recording sheet transported by a sheet feeder.

The sheet feeder picks up a recording sheet from a paper feed cassette using a pick-up roller, and, subsequently, transports the recording sheet to, via a separation roller, a transfer position at a proper timing determined by a pair of registration rollers. At the transfer position, the toner image is transferred to the recording sheet.

With respect to this type of image forming apparatus, in order to achieve high productivity when consecutively forming images on a plurality of recording sheets, it is desirable that a sheet interval (i.e., the interval between the trailing edge of a recording sheet fed earlier (hereinafter, referred to as a "preceding sheet") and the leading edge of the recording sheet fed subsequently to the preceding sheet is as short as possible.

Note that, when the pick-up roller picks up the uppermost recording sheet from a stack of recording sheets stored in the paper feed cassette, the second uppermost recording sheet occasionally picked up together with the uppermost one at a time. The second uppermost recording sheet (hereinafter, referred to as the "following sheet") is forcibly separated from the preceding sheet (i.e., the uppermost recording sheet) by the separation roller. However, in some cases, the sheets separate spontaneously at a position between the pick-up roller and the separation roller. Accordingly, the position where the following sheet is separated from the preceding sheet can be different each time.

One approach to controlling the sheet interval to be constant is, for example, to determine the timing when the following sheet is transport based on the separation timing (i.e., the timing when the preceding sheet is forwarded and the trailing edge thereof is separated from the leading edge of the following sheet). This approach requires accurate detection of the timing when the preceding sheet is separated from the following sheet.

For example, Japanese Patent Application Publication No. 2012-236684 discloses the following: light emitted by a single light emitting element travels through a light diffusion plate, and irradiates a predetermined section along the direction of a transport path, the section starting from the vicinity of a pick-up position where the pick-up roller comes into contact with a recording sheet; the light with which the predetermined section is irradiated is converged, by a light converging plate, onto a light receiving surface of a single light receiving element located on one side of the transport path opposite to the other side on which the light source is located;

When a gap occurs as a result of the separation between the preceding sheet and the following sheet, the output from the light receiving element varies due to the light passing through the gap, which allows for the detection of the timing of separation between the preceding sheet and the following sheet within the predetermined section.

However, the gap detection method according to Japanese Patent Application Publication No. 2012-236684 requires a space large enough to arrange both the light diffusion plate and the light converging plate as optical elements. This makes it difficult to miniaturize the image forming apparatus. In addition, these optical elements are not inexpensive, and therefore increase the cost of the apparatus.

In view of the above, the inventors of the present invention devised a structure in which: a light emitting element emitting diffused light and a light receiving element are disposed on a first side of the sheet transport path; and a converging reflector is disposed on the other side of the sheet transport path for converging, onto the light receiving element, light that is emitted by the light emitting element and reaches the converging reflector by travelling across a predetermined section of the sheet transport path from the pick-up position of the pick-up roller to the separation roller.

When a gap occurs between the preceding sheet and the following sheet, the light passing through the gap is reflected by the converging reflector and is subsequently received by the light receiving element after passing through the gap again. The timing when the separation occurs between the preceding sheet and the following sheet is detected based on the variation in the output from the light receiving element.

Since the above-mentioned structure requires no optical element other than the converging reflector, this structure contributes to space saving, and achieves cost reduction.

However, the inventors found by repeating experiments with prototypes that this structure might cause detection error depending on the type of a sheet.

SUMMARY OF THE INVENTION

The present invention has been made in view of the above problems and aims to provide a sheet feeder, a document reader, and an image forming apparatus each of which is capable of achieving space saving and cost reduction, while improving productivity by controlling properly the interval between sheets picked up together at a time.

In order to achieve the above aim, a first aspect of the present invention is a sheet feeder for sequentially picking up sheets from a sheet stack and continuously transporting the sheets along a sheet transport path, the sheet feeder including: a transport unit that transports the sheets along the sheet transport path one by one; a gap occurrence detection unit that detects, within a predetermined section of the sheet transport path, occurrence of a gap between the trailing edge of a preceding sheet and the leading edge of a following sheet; and a controller that controls a timing at which the transport unit starts transporting the following sheet according to a result of the detection by the gap occurrence detection unit, the gap occurrence detection unit including a first detection unit and a second detection unit, the first detection unit including: a first light emitting element that is disposed on a first side of the sheet transport path and emits diffused light at least toward the predetermined section; a first light receiving element that is disposed on the first side of the sheet transport path; and a converging reflector that is disposed on a second side of the sheet transport path opposite the first side and converges, onto the first light receiving element, light that is emitted by the first light emitting element and reaches the converging reflector by travelling across the predetermined section, and the second detection unit including: a second light emitting element;

and a second light receiving element that is located in a position to detect light emitted by the second light emitting element and reflected by a sheet passing through the predetermined section, wherein the gap occurrence detection unit detects occurrence of the gap based on outputs from the first detection unit and the second detection unit while the preceding sheet and the following sheet are passing through the predetermined section.

A second aspect of the present invention is a sheet feeder for sequentially picking up sheets from a sheet stack and continuously transporting the sheets along a sheet transport path, the sheet feeder including: a transport unit that transports the sheets along the sheet transport path one by one; a gap occurrence detection unit that detects, within a predetermined section of the sheet transport path, occurrence of a gap between the trailing edge of a preceding sheet and the leading edge of a following sheet; and a controller that controls a timing at which the transport unit starts transporting the following sheet according to a result of the detection by the gap occurrence detection unit, wherein the gap occurrence detection unit includes: a light emitting element that is disposed on a first side of the sheet transport path and emits light at least toward the sheet transport path; a light receiving element that is disposed on the first side of the sheet transport path; and a converging reflector that is disposed on a second side of the sheet transport path opposite the first side and converges, onto the light receiving element, light that is emitted by the light emitting element and reaches the converging reflector by travelling across the predetermined section, wherein the sheet transport path and the set of the light emitting element, the light receiving element, and the converging reflector are arranged such that reflection light of the light emitted by the light emitting element that is regularly reflected by the sheet being transported along the predetermined section of the sheet transport path is not received by the light receiving element.

A third aspect of the present invention is a document reader including the above-mentioned sheet feeder as a document feeder.

A forth aspect of the present invention is an image forming apparatus including the above-mentioned sheet feeder as a recording sheet feeder.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENTS

The following describes an embodiment of a sheet feeder according to the present invention, by way of an example in which the sheet feeder is applied to a paper feed unit of a copier.

Embodiment 1

Figure 1:
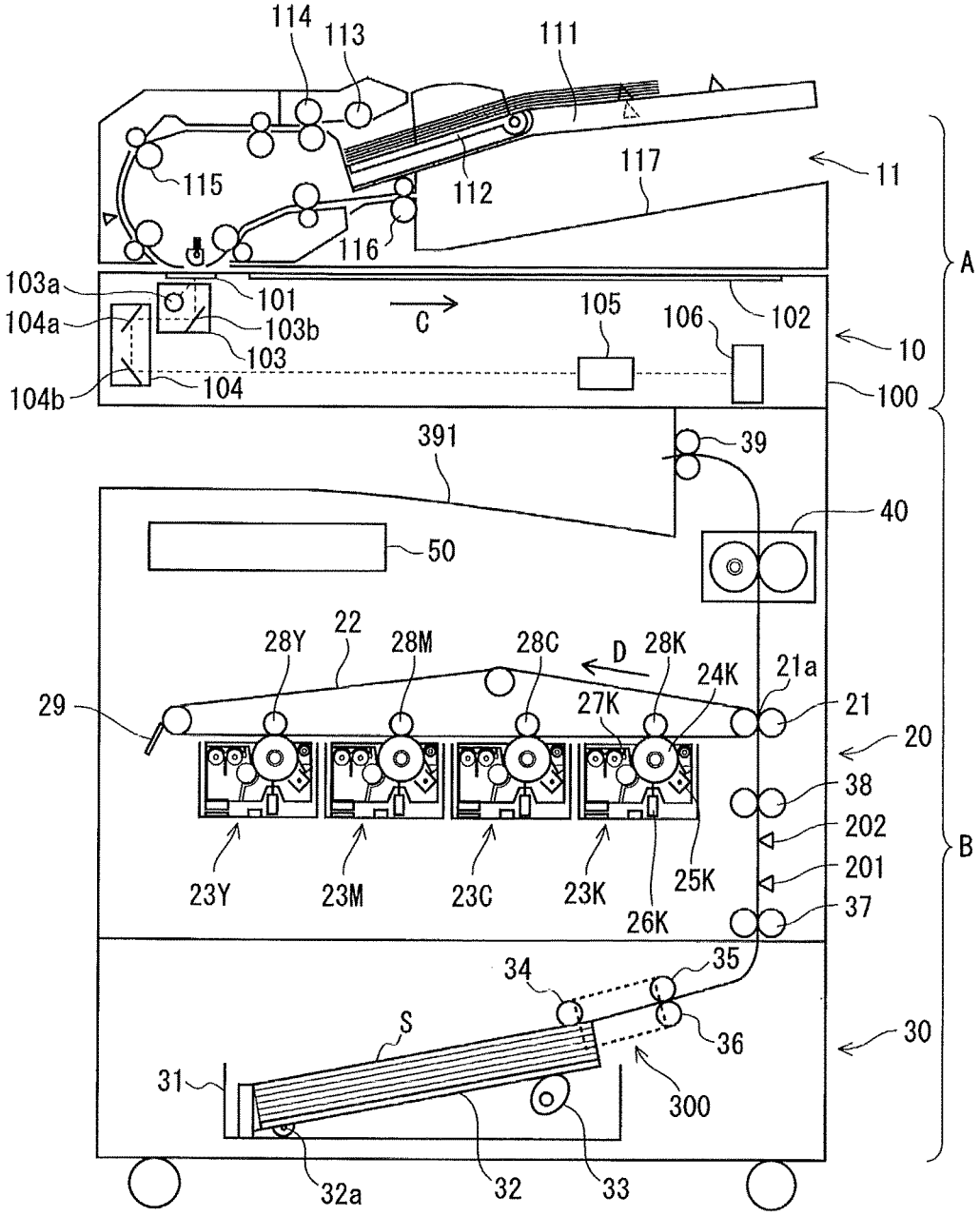
FIG. 1 is a schematic view showing the overall structure of a copier pertaining to Embodiment 1 of the present invention.

FIG. 1 is a schematic view showing the structure of a copier according to the present embodiment.

As shown in the figure, the copier 1 is roughly composed of an image reader unit (document reading apparatus) A and a printer unit (image forming apparatus) B.

The image reader unit A includes a scanner unit 10 for optically reading a document image and converting it to image signals, and a document transport unit (ADF unit) 11 positioned above the scanner unit 10. The image reader unit A is configured to read a document image by either a sheet-through mode or a mirror scan mode, selectively.

The printer unit B forms a color image on a recording sheet, by an electro-photographic method, based on the document image read by the image reader unit A or image data transferred via a network from an external terminal.

The following describes the structure of each of the above-mentioned units.

(1) Image Reader Unit A (1-1) Document Transport Unit

In the case of reading in the sheet-through mode, the document transport unit 11 picks up sheets using a pick-up roller 113 from the stack of document sheets in a document feed tray 111, and separates the sheets one by one using a separation roller unit 114, performs skew correction using a pair of registration rollers 115, feeds the document sheet at a controlled timing to a reading position on the first reading glass 101, and, after the document sheet has been read at the reading position, finally ejects the document sheet onto a document output tray 117 using a pair of ejection rollers 116.

The document feed tray 111 is provided with a lift plate 112. When the pick-up roller 113 performs pick-up, the lift plate 112 is driven to rotate upwards by a cam mechanism or the like (not shown), such that the upper surface of the uppermost document sheet of the stack comes into contact with the pick-up roller 113.

(1-2) Scanner Unit

The scanner unit 10 includes a housing 100 having an upper surface on which a strip-like first reading platen glass 101 and a flat-plate-like second reading glass 102 are provided.

The housing 100 houses a first slider 103, a second slider 104, a collecting lens 105, a line sensor 106, and so on arranged therein.

The line sensor 106 includes a plurality of CCDs (Charge Coupled Devices) arranged along a straight line on a substrate.

The first slider 103 includes a linear light source 103*a* and a first mirror 103*b*, and is driven to slide by a driving motor, which is not shown, in a direction indicated by an arrow C.

The second slider 104 includes a pair of mirrors 104*a* and 104*b* arranged to form an angle of 90 degrees. The second slider 104 is configured to be driven by a wire drive system using a moving pulley to move in the same direction C as the first slider 103 at half speed of the first slider 103.

Typically, light sources such as a fluorescent lamp, xenon lamp, and LED (light emitting diode) are used as the linear light source 103*a*.

In the case of reading an image of a document placed manually on the second reading glass 102 (i.e., reading using the mirror scan method), the linear light source 103*a* emits light toward the document placed on the second reading glass 102 while the first slider 103 slides in the direction indicated by the arrow C.

Since the second slider 104 including the second and third mirrors 104*a* and 104*b* is configured to slide in the direction C at half speed of the moving speed of the first slider 103, the length of the optical path from the document surface to the collecting lens 105 is kept constant. This structure allows reflection light from the document placed on the second reading glass 102 to be focused on the line sensor 106 via the collecting lens 105.

Whereas, in the case of reading an image of a document transported over the first reading glass 101 by the document transport unit 11 (i.e., in the sheet-through mode), the first slider 103 is held at a position where the linear light source 103*a* can emit light toward the document from below the first reading glass 101, as shown in FIG. 1.

The line sensor 106 converts the light reflected by the document into electrical signals, and output the electrical signals to the controller 50.

(2) Printer Unit

The printer unit B includes an image forming unit 20, a paper feed unit 30, a fixing unit 40, a controller 50, and so on.

The image forming unit 20 includes an intermediate transfer belt 22 driven to rotate in a direction indicated by an arrow D by a driver which is not shown, and process units 23Y, 23M, 23C, and 23K disposed below the intermediate transfer belt 22 and arranged in a line along a horizontal portion of the running path of the intermediate transfer belt 22.

The process units 23Y, 23M, 23C, and 23K respectively form toner images in yellow (Y), magenta (M), cyan (C), and block (B).

The process units 23Y, 23M, 23C, and 23K are basically the same in the structure except for the color of toner filled therein. Accordingly, the following describes the structure of the process units with reference to the process unit 23K only.

The process unit 23K includes a photosensitive drum 24K, and also includes a charger 25K, an exposure 26K, and a developer 27K disposed around the photosensitive drum 24K.

The circumference surface of the photosensitive drum 24K is uniformly charged by the charger 25K.

The exposure 26K drives the laser light source according to the image data acquired by the image reader unit A so as to scan and expose the charged surface of the photosensitive drum 24K. Consequently, an electrostatic latent image is formed on the outer circumference surface of the photosensitive drum 24K.

The electrostatic latent image is developed by the developers 27K with a black toner.

A first transfer roller 28K is further disposed above the photosensitive drum 24K across the intermediate transfer belt 22.

An electric field is formed between the first transfer roller 28K and the photosensitive drum 24K. Consequently, the toner image on the photosensitive drum 24K is transferred onto the intermediate transfer belt 22 under the effect of the electric field.

Similarly, first transfer rollers 28Y, 28M, and 28C are respectively disposed above other process units 23Y, 23M, and 23C across the intermediate transfer belt 22. The toner images in yellow, magenta, and cyan respectively formed on the photosensitive drums of the process units 23Y, 23M, and 23C are transferred onto the intermediate transfer belt 22. The toner images in yellow, magenta, cyan, and black are transferred and superposed on the same position on the intermediate transfer belt 22 so as to form a color image.

The toner images transferred to the intermediate transfer belt 22 are transported, by the rotation of the intermediate transfer belt 22, to a secondary transfer position 21*a*, where the toner images face the secondary transfer roller 21.

In parallel, the paper feed unit 30 picks up recording sheets S from a stack of recording sheets stored in a paper feed cassette 31, and transports the recording sheets S one at a time to the secondary transfer position 21*a*.

The stack of recording sheets S is placed on a lifting/lowering plate 32 in the paper feed cassette. The lifting/lowering plate 32 is supported to rotate upwards or downwards about a rotation shaft 32*a*. A cam plate 33 that is driven to rotate by a driver (not shown) rotates the lifting/lowering plate 32 upwards, such that the surface of the uppermost one of the stack of the recording sheets S comes into contact with the circumference surface of the pick-up roller 34.

The recording sheet S picked up by the rotation of the pick-up roller 34 passes through a nip (separation nip) between a feed roller 35 and the separation roller 36. A predetermined load torque in the reverse direction of the paper transport direction is applied to the separation roller 36 by a torque limiter that is not shown. If the pick-up roller 34 feeds multiple recording sheets S at a time, one of the sheets is separated from the rest at the separation nip.

The recording sheet S separated from the others at the separation nip is transported vertically, via a pair of vertical transport rollers 37, to the pair of registration rollers 38 disposed downstream in the sheet transport direction (hereinafter, in the present specification, the terms "downstream" and "upstream" refer to the downstream direction and the upstream direction along the recording sheet transport path). For convenience sake, the section of the transport path of the paper feed unit 30 from the pick-up roller 34 to the feed roller 35 is referred to as a "pick-up section", and the section of the same from the pair of vertical transport rollers 37 to the pair of ejection rollers 39 is referred to as a "vertical transport portion".

In the vertical transport portion, a reference numeral 201 donates a vertical transport sensor, and a reference numeral 202 donates a timing sensor. The sensors 201 and 202 each comprises, for example, a reflective light sensor provided with a light emitting element and a light receiving element. The light receiving element receives light emitted by the light emitting element and reflected by a sheet. The sensors are used for detecting the leading edge or the trailing edge of a recording sheet S at the detection positions thereof.

For example, the controller 50 judges that the leading edge of a recording sheet S has passed through the detection position of the vertical transport sensor 201 when the detection signal from the vertical transport sensor 201 rises from OFF to ON, and judges that the trailing edge of the recording sheet S has passed through the detection position of the vertical transport sensor 201 when the detection signal from the vertical transport sensor 201 falls from ON to OFF.

When the vertical transport sensor 201 disposed immediately downstream from the pair of vertical transport rollers 37 detects the leading edge of a recording sheet S, drive of the pick-up roller 34 and the feed roller 35 disposed in the pick-up section is stopped.

The pick-up roller 34 and the feed roller 35 are each driven to rotate by a corresponding sheet feeding motor using a one-way clutch (not shown). The one-way clutch is of a well-known type that transmits power only in one rotation direction. In the present embodiment, when each sheet feeding motor rotates in a predetermined direction to transport a recording sheet to the downstream (i.e., to a secondary transfer roller 21), the one-way clutch transmits torque to the shaft of the corresponding roller. Whereas, when drive of the sheet feeding motor is stopped, the one-way clutch allows for the rotation of the corresponding roller without drive power. Accordingly, the pair of vertical transport rollers 37 can transport a recording sheet S without trouble.

Initially, the pair of registration rollers 38 is at a standstill. After the timing sensor 202 has detected the leading edge of a recording sheet S, the pair of vertical transport rollers 37 transports the recording sheet S for a predetermined period. Consequently, the recording sheet S is bowed between the pair of vertical transport rollers 37 and the pair of registration rollers 38, and the stiffness of the recording sheet S causes the leading edge thereof to be positioned along a nip formed between the pair of registration rollers 38.

Subsequently, the pair of registration rollers 38 starts rotating at a predetermined timing. In this way, skew correction is made. The recording sheet S after skew correction is transported to the secondary transfer position 21*a* in the downstream, where the toner image in full color is transferred to the recording sheet S.

Note that, in the section of the paper feed unit 30 surrounded by a broken line between the pick-up roller 34 and the feed roller 35, a gap occurrence detection unit 300 is provided for detecting separation of one of multiple recording sheets S picked up at a time by the pick-up roller 34 from the others. The detection result is used for controlling the timing of transporting the following recording sheet. The details thereof will be described later.

After the toner image has been transferred to the recording sheet at the secondary transfer position 21*a*, heat and pressure is applied to the recording sheet by the fixing unit positioned above the secondary transfer position 21*a*. Consequently, the transferred toner image is fixed onto the recording sheet.

The recording sheet onto which the toner image has been fixed is ejected onto an ejection tray 391 via the pair of ejection rollers 39.

The residual toner on the intermediate transfer belt 22 which has not transferred to the recording sheet is removed by a cleaning blade 29.

The above description applies to the process in a color mode. Whereas, when monochrome (e.g., black) printing is performed (i.e., in a monochrome mode), only the process unit 23K for black printing is driven to perform the above-mentioned steps of charging, exposure, developing, transfer, and fusing for forming black image on the recording sheet.

On a front-upper side of the copier 1, an operation panel 60 (shown in FIG. 5, not in FIG. 1) is provided at a position where a user can easily operate the operation panel. The operation panel 60 is provided with buttons, a liquid crystal display of touch-panel type, and so on, for receiving various instructions from the user. The operation panel 60 sends the received instructions to the controller 50, and information indicating the status of the copier 1 is displayed on the liquid crystal display of the operation panel 60.

The controller 50 controls the document transport unit 11 and the scanner unit 10 in the image reader unit A, the image forming unit 20, the paper feed unit 30, and the fixing 40 in the printer unit B, to achieve smooth copying and printing.

Specifically in the control process of the paper feed unit 30, the controller 50 uses the gap occurrence detection unit 300 for detecting the gap between the trailing edge of a preceding sheet S1 and the leading edge of a following sheet S2, and controls the timing of transporting the following sheet S2.

(3) Gap Occurrence Detection Unit (3-1) Structure of Gap Occurrence Detection Unit 300

Figure 2A:
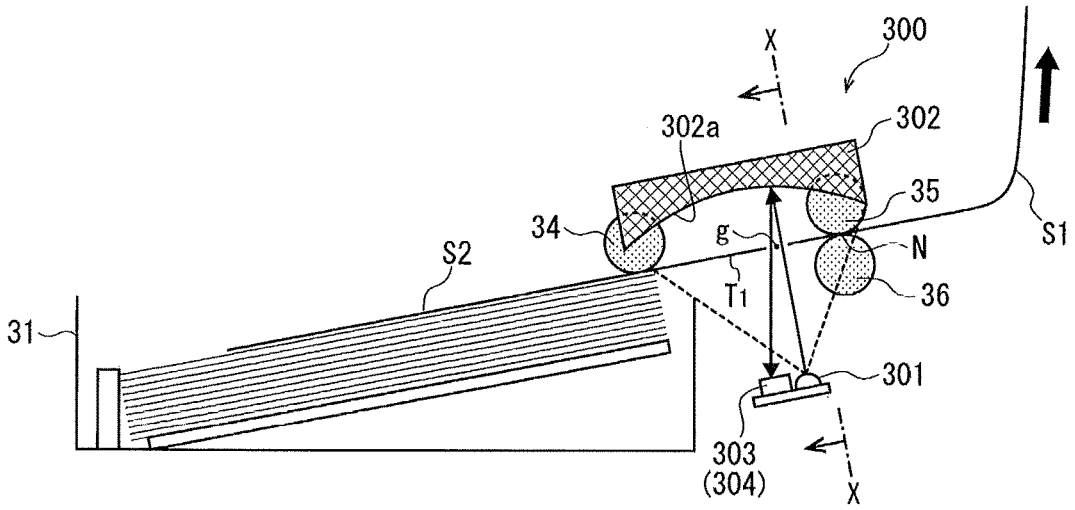
FIG. 2A shows the structure of a gap occurrence detection unit of a paper feed unit in the copier pertaining to Embodiment 1.
Figure 2B:
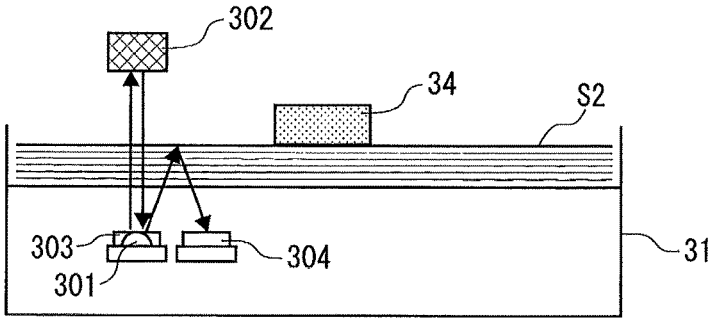
FIG. 2B shows a schematic cross-section along the line X-X in FIG. 2A, viewed in the direction indicated by the arrows.

FIG. 2A is a schematic side view showing the structure of the gap occurrence detection unit 300 of the paper feed unit 30 in the copier 1, disposed along a sheet transport path T1 extending from the pick-up roller 34 to the separation nip N. FIG. 2B is a schematic section view along the line X-X in FIG. 2A.

As shown in FIG. 2A, the gap occurrence detection unit 300 includes a light emitting element 301 and a light receiving element 303 which are disposed on a single substrate below the sheet transport path T1 so as to be adjacent to each other along in the direction of the sheet transport path T1. FIG. 2B shows that a light receiving element 304 is located at a position slightly displaced from the light receiving element 303 in a width direction of a sheet transported on the sheet transport path T1. Right above the light emitting element 301 and the light receiving element 303, a converging reflector 302 with a reflection surface 302*a*, which is curved in a concave shape, is disposed to face the light emitting element 301 and the light receiving element 303, with the sheet transport path T1 intervened therebetween.

The sheet transport path T1 is specifically formed by a pair of upper and lower transport guides (not shown). One of surfaces of each transport guide which comes into contact with and guides a recording sheet S is defined as a sheet transport surface. The transport guides are provided with slits or the like such that an optical path of diffused light from the light emitting element 301 may not be shut off.

Figure 3:
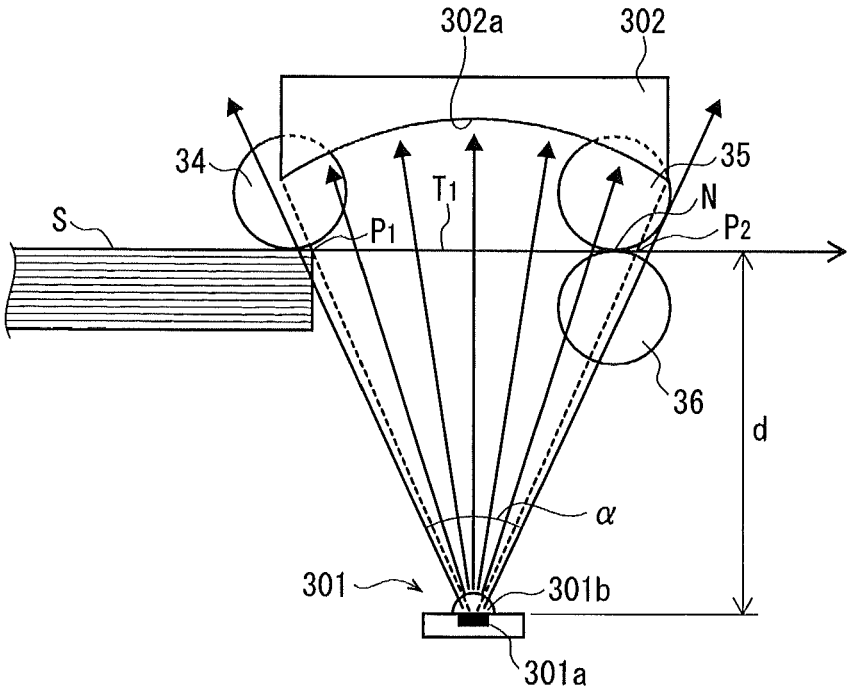
FIG. 3 shows the positional relation among a light emitting element, converging reflector, and sheet transport path in the gap occurrence detection unit.

FIG. 3 illustrates a positional relation among the light emitting element 301, the converging reflector 302, and the sheet transport path T1.

As shown in the figure, the light emitting element 301 is composed of an LED (Light Emitting Diode) 301*a* emitting visible light and a nearly hemispherical lens 301*b* attached to the light-emitting surface of the LED 301*a*. The nearly hemispherical lens 301*b* enables the light emitting element 301 to emit diffused light.

In terms the diffusivity (i.e., the diffusion angle $\alpha$) of the diffused light in a direction along the sheet transport direction, the hemispherical lens 301*b* is designed such that, when the light emitting element 301 is disposed at a predetermined distance d from the sheet transport path T1, the diffused light travels across at least a section between a position P1 of the leading edge of the uppermost recording sheet S of the stack of recording sheets stored in the paper feed cassette 31 and a position P2 slightly downstream from the separation nip N.

Accordingly, for example, in the case that the specifications of the device require the distance d to be smaller, the hemispherical lens 301*b* is designed to achieve a greater diffusion angle $\alpha$.

The means for converting light from a light source with the strongest directionality into diffused light is not limited to the above-mentioned hemispherical lens. For example, Fresnel lens utilizing light refraction and ones utilizing diffraction, diffusion, or reflection of light may be used.

Note that, a position P1, which is the most upstream position in the detection area of the gap occurrence detection unit 300*a*, may be defined as a pick-up position at which the pick-up roller 34 comes into contact with a recording sheet S. However, when the position P1 is the pick-up position, diffused light is blocked by the leading edge portion of the stack of recording sheets. This is the reason why the leading edge of the uppermost recording sheet S is defined as the position P1 in the present embodiment.

In addition, the following sheet S2 is usually separated from the preceding sheet S1, at the latest, at the separation roller 36. The most downstream position P2 in the detection range of the gap occurrence detection unit 300 may be determined to match with the position of the separation nip N. However, in the present embodiment, the position P2 is set downstream from the separation nip N by a predetermined distance, such that gap occurrence can be detected when the gap occurs as a result of the sheet separation operation performed at the separation nip N. Accordingly, the distance from the separation nip N to the position P2 along the sheet transport path is longer than the minimum width of a gap g that can be detected by the gap occurrence detection unit 300.

As the light source of the light emitting element 301, the above-mentioned LED is superior in the small power consumption, long life cycle, and property close to that of a point light source. However, of course, the light source is not limited to the LED.

In the present embodiment, a photodiode (PD) that can detect light having a wavelength in a region of that emitted by the light emitting element 301 is used as the light receiving elements 303 and 304. However, the light receiving elements 303 and 304 are not limited to the photodiode.

The concave shape of the reflection surface 302*a* of the converging reflector 302 is optically designed such that light emitted by the light emitting element 301 and reflected by the reflection surface 302*a* of the converging reflector 302 is always converged onto the light-receiving surface of the light receiving element 303, even if the incident position of the light varies in the direction of the sheet transport path.

The distance between the both ends of the reflection surface 302*a* of the converging reflector 302 in the direction along the sheet transport path is determined such that the diffused light emitted by the light emitting element 301 and passing through a section defined between the positions P1 and P2 is entirely incident within the reflection surface 302*a*.

The converging reflector 302 is made up by forming a mirror surface on the concave surface of a converging reflector body. The mirror surface serves as the reflection surface 302*a*. The body is formed, for example, by injection-molding of a resin material. The reflection surface 302*a* is formed by plating, evaporation, or the like. Note that a glass material may be also applicable. Alternatively, the body may be made of a metallic material by means of cast-molding, and the curved portion thereof may be mirror-finished.

Referring back to FIG. 2B, another light receiving element 304 is located at a position slightly displaced from the light receiving element 303 in a direction orthogonal to the sheet transport direction (i.e., in the width direction of a recording sheet). The position of the light receiving element 304 is determined such that reflection light reflected by the converging reflector 302 from the light emitting element 301 (regular reflection light) is not incident on the position, even when no recording sheet is in the sheet transport path T1, and such that reflection light reflected by a recording sheet transported along the sheet transport path after being emitted by the light emitting element 301 (regular reflection light) enters the light receiving element 304.

Accordingly, a diffusion angle of the light emitting element 301 in the width direction of the recording sheet may be set to any angle as long as the regular reflection light of the diffused light that is reflected by a recording sheet may enter the light receiving element 304. The diffusion angle in the width direction needs not be the same as the diffusion angle $\alpha$ along the sheet transport path shown in FIG. 2A.

Note that the light receiving element 304 may be arranged in alignment with the light emitting element 301 and the light receiving element 303 along the direction of the sheet transport path, as long as the light receiving element 304 is positioned such that the reflection light from a recording sheet enters the light receiving element 304, but the reflection light from the converging reflector 302 does not enter the light receiving element 304. According to this arrangement, light from the light emitting element 301 needs not be diffused in the width direction of a recording sheet. In other words, it suffices that the light from the light emitting element 301 is diffused at least in the direction along the sheet transport path.

Note that, in order to detect gap occurrence even between sheets of the minimum size, the light emitting element 301, the light receiving elements 303 and 304, and so on of the gap occurrence detection unit 300 are disposed closer to the pick-up roller 34 than the edge of a recording sheet of the minimum size in the width direction of the sheet.

(3-2) Variation in Outputs from Light Receiving Elements 303 and 304

Figure 4:
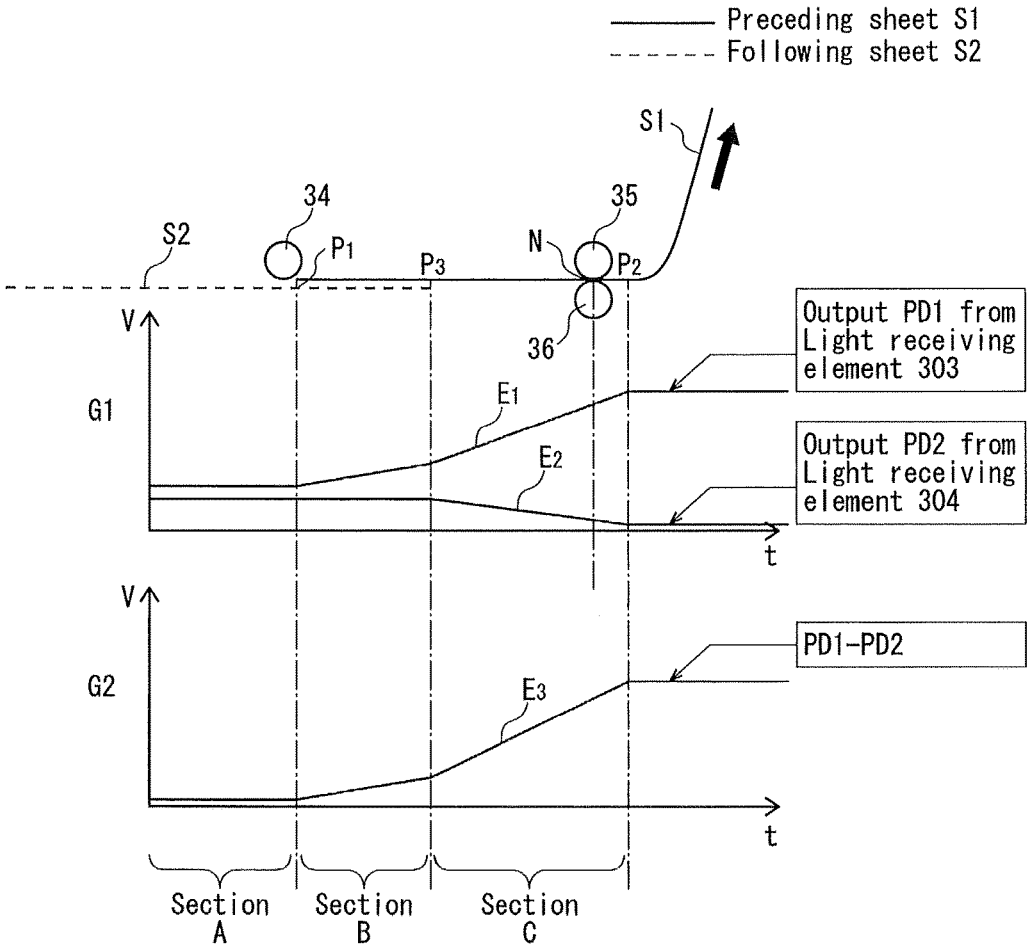
FIG. 4 shows the variation over time in outputs of light receiving elements 303 and 304 in the gap occurrence detection unit in Embodiment 1 in the case that a preceding sheet S1 and a following sheet S2 are picked up together at a time and the following sheet S2 stops at a position P3.

FIG. 4 shows a graph G1 indicating variation in the outputs from the light receiving elements 303 and 304 in the case that the pick-up roller 34 picks up the uppermost recording sheet from sheets stored in the paper feed cassette 31 (i.e., the preceding sheet S1), together with the next recording sheet (i.e., the following sheet S2), and the following sheet S2 eventually stops at a position P3 between the pick-up roller 34 and the separation nip N.

For easy understanding, positions of the preceding sheet S1 and the following sheet S2 on the actual sheet transport path are shown above the graph G1 in a corresponding manner.

The horizontal axis of the graph G1 represents an elapsed time t. The length of the sheet transport path in the graph is determined based on the transport speed of the preceding sheet S1, such that the elapsed time t substantially corresponds to the position of the trailing edge of the preceding sheet S1. The vertical axis of the graph G1 represents the magnitude of the output voltages of the light receiving elements.

Broken lines E1 and E2 indicate variation in the output PD 1 of the light receiving element 303 and that in the output PD2 of the light receiving element 304, respectively.

During the period in which the trailing edge of the preceding sheet S1 is within a section A in the graph G1, the size of an overlapping area of the preceding sheet S1 and the following sheet S2 is constant within the detection region (i.e., the region from the position P1 to the position P2) of the gap occurrence detection unit 300. Consequently, the outputs PD1 and PD2 from the light receiving elements 303 and 304 are constant. The output PD1 is slightly greater than the output PD2. This is because, in addition to reflection light from the preceding sheet S1 and the following sheet S2, the light receiving element 303*a* receives a certain amount of light that first passes through one or both of the sheets, is then reflected by the converging reflector 302, and finally passes through one or both of the sheets again (hereinafter, referred to as "light through sheet"). The thinner the recording sheet is, the larger the amount of the light through sheet is.

Whereas, the light receiving element 304 is located at a position where the reflection light from the converging reflector 302 is not incident directly. Consequently, the light receiving element 304 does not receive the light through sheet, but receives only the reflection light from the preceding sheet S1 and the following sheet S2. Accordingly, the light receiving element 304 receives a less amount of light than the light receiving element 303.

When the preceding sheet S1 is further transported such that the trailing edge thereof transits from the section A to a section B across the position P1 (the position of the preceding sheet S1 shown in FIG. 4 exactly corresponds to the moment of the transition), the overlapping area of the preceding sheet S1 and the following sheet S2 within the detection region starts decreasing, and, consequently, the amount of the light through sheet incident on the light receiving element 303 increases. Consequently, the output PD1 of the light receiving element 303 gradually increases.

As the amount of the light through sheet increases due to the decrease in the overlapping area of the preceding sheet S1 and the following sheet S2, the amount of the reflection light from the area slightly decreases. Consequently, the output PD2 of the light receiving element 304 decreases slightly and gradually.

Subsequently, when the preceding sheet S1 is further transported and the trailing edge thereof transits to a section C via the stop position P3 of the leading edge of the following sheet S2, a gap occurs between the sheets, and the gap gradually widens. Consequently, the amount of light emitted by the light emitting element 301 and directly reflected by the converging reflector 302 (hereinafter, referred to as "direct reflection light") increases. As a result, the output from the light receiving element 303 increases at a higher rate than in the section B.

In contrast, the amount of reflection light from the sheets decreases as the gap widens. The output PD2 of the light receiving element 304 decreases at a higher rate than in the section B.

Since the stop position P3 of the following sheet S2 differs for each sheet being fed, the output from the light receiving element 303 when the gap occurs varies significantly. Therefore, in the present embodiment, the gap g is detected basically based on the change in the rate of increase of the output (i.e., the inclination of the lines in the graph).

However, as shown in the graph G1 in FIG. 4 for example, the broken line E1 representing the output PD1 of the light receiving element 303 slightly inclines upward inclination also at the position P1, and, furthermore, the inclination is not significantly different from that at the position P3. Accordingly, there is a risk that occurrence of the gap g is erroneously detected at the position P1.

This is for the reason is that irregular reflection light from the sheet, in addition to the direct reflection light from the converging reflector 302, enters the light receiving element 303, and this light, serving as a noise, makes it difficult to detect the occurrence of the gap. It may be possible that, for certain types of sheet, the gap g can be detected based on a specific inclination value as a threshold. However, other types of sheets differ in glossiness or color of the surface thereof from one another, which results in the difference of the amount of reflection light from the sheets. Consequently, the inclination values at the positions P1 and P3 vary for each sheet.

In particular, a glossy sheet reflects a larger amount of light. Consequently, the variation in the output PD1 between the section B and the section C is very small, and therefore a detection error is likely to occur.

Accordingly, in the present embodiment, in order to eliminate influence of the amount of the reflection light from sheets on the amount of the light received by the light receiving element 303, the detected value PD2 of the light receiving element 304 is subtracted from the detected value PD1 of the light receiving element 303, and the occurrence of the gap is detected based on the variation in the value of "PD1−PD2".

The broken line E3 in the graph G2 shown in FIG. 4 represents the variation in the difference between the detected values (PD1−PD2). As shown in the graph, difference between the variation in the inclination at the position P3 and that at the position P1 is large. This reduces risk of a detection error.

In this graph, the variation in the inclination at the position P1 and that at the position P3 are free from the influence of the reflection light from recording sheets. Accordingly, difference of reflectivity between types of a recording sheet to be used has almost no influence.

Accordingly, gap occurrence can be detected precisely by setting a specific threshold of inclination and comparing the increase in the inclination of the calculated difference (PD1−PD2) with the specific threshold.

(4) Controller 50

Figure 5:
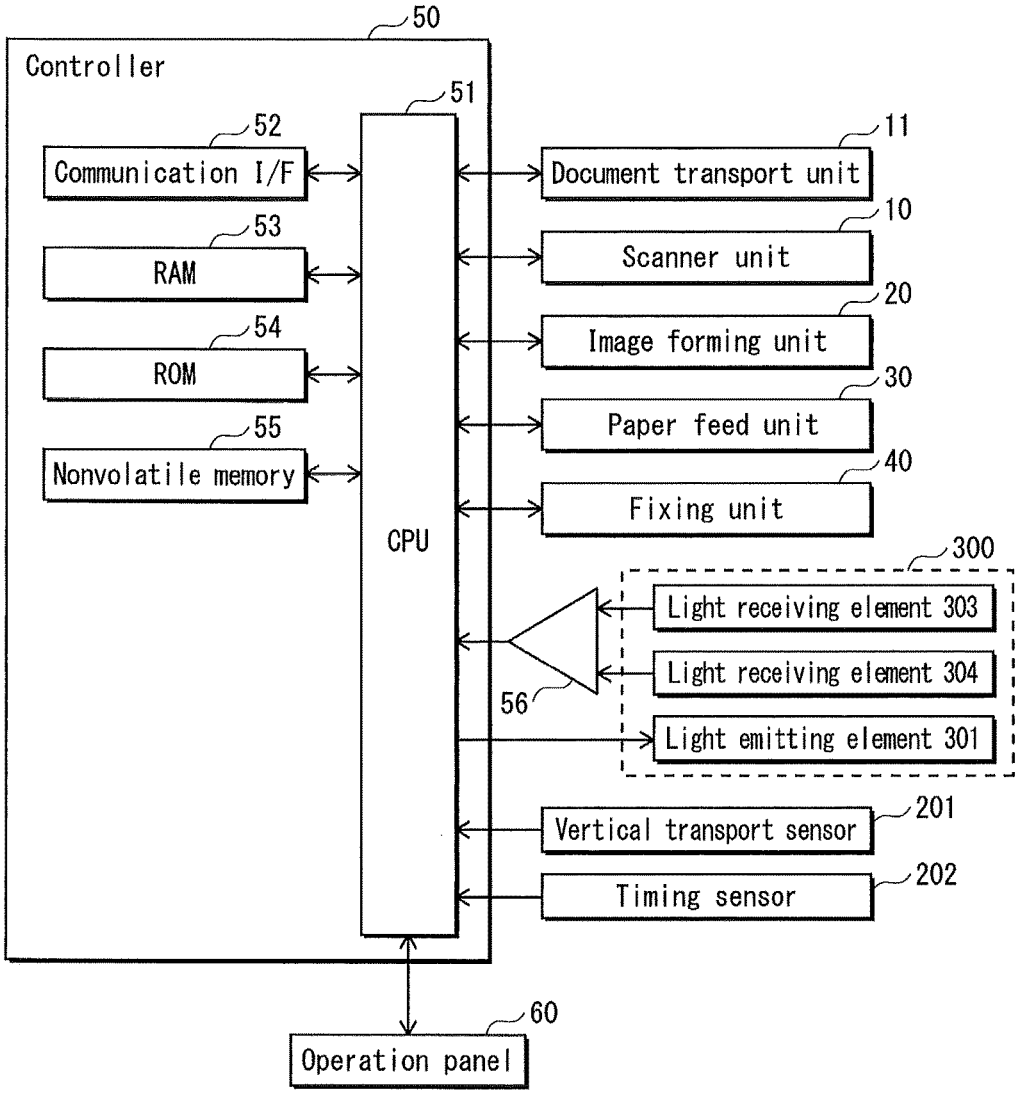
FIG. 5 is a block diagram showing the structure of a controller of the copier.

FIG. 5 is a block diagram showing major components of the controller 50.

As shown in the figure, the controller 50 includes a CPU (Central Processing Unit) 51, communication I/F (Interface) 52, RAM (Random Access Memory) 53, ROM (Read Only Memory) 54, and nonvolatile memory 55 such as EEPROM (Registered Trademark).

The CPU 51 reads out a control program from the ROM 54 when the copier 1 is powered on, for example, and then executes the control program using the RAM 53 as a working storage area.

In addition, the CPU 51 receives a printing job from an external terminal, using the communication I/F 52, via a communication network such as a LAN.

The nonvolatile memory 55 stores history information used mainly for maintenance, such as a cumulative number of prints and so on, and a password used for login.

The CPU 51 controls the document transport unit 11 and the scanner unit 10 in the image reader unit A for reading document image and generating image data. The CPU 51 further controls the image forming unit 20, the paper feed unit 30, and the fixing unit 40 in the printer unit B, according to the image data or printing job data received from an outer terminal via communication I/F, such that copying or printing is performed smoothly.

Specifically, the difference calculation circuit 56 calculates the difference between the outputs from the light receiving elements 303 and 304 in the gap occurrence detection unit 300, and inputs the calculated difference to the CPU 51. The CPU 51 detects the gap between the trailing edge of the preceding sheet S1 and the leading edge of the following sheet S2 according to the calculated difference, and also controls the record sheet feeding by the paper feed unit 30 according to the outputs from the vertical transport sensor 201 and the timing sensor 202.

(5) Sheet Feed Control

The following describes a sheet feed control performed by the controller 50 for recording sheets in the paper feed unit 30. Note that the term "sheet feed control" indicates the control from when a recording sheet in the paper feed cassette 31 is picked up until when the recording sheets has been transported to the pair of registration rollers 38. Description is omitted for the skew correction, timing control, and so on performed by the pair of registration rollers 38.

Figure 6:
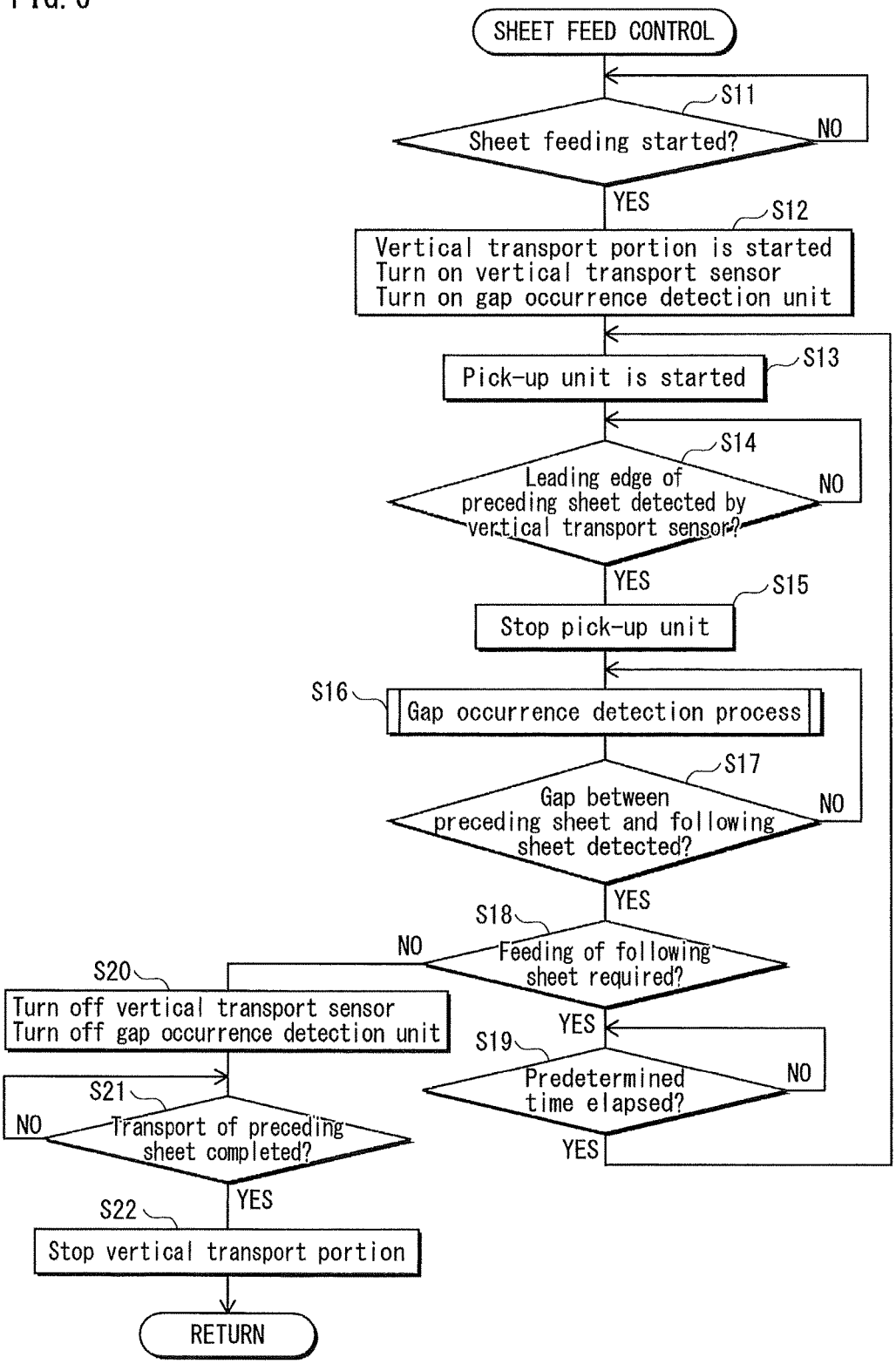
FIG. 6 is a flowchart showing the details of sheet feed control pertaining to Embodiment 1.

FIG. 6 is a flowchart showing the process of the sheet feed control. The process shown in the flowchart is performed as a subroutine of a main routine (not shown) for controlling the entire operation of the copier 1.

As the first step, the controller 50 judges whether or not the start timing of sheet feeding is reached (Step S11). The start timing is determined by the controller 50 in accordance with the progress of the image forming operation performed by the image forming unit 20.

When judging that the start timing is reached, the controller 50 controls the vertical transport portion of the paper feed unit 30 to start. In addition, the controller 50 turns on the vertical transport sensor 201, and the gap occurrence detection unit 300 including the light emitting element 301 and the light receiving elements 303 and 304 (Step S12).

Subsequently, the controller 50 controls the pick-up unit (i.e., the pick-up roller 34 and the feed roller 35) to start picking up a preceding sheet S1 (Step S13).

The controller 50 judges whether or not the vertical transport sensor 201 has detected the leading edge of the preceding sheet S1 (Step S14). When the leading edge has been detected (Step S14: YES), it means that the preceding sheet S1 has passed through the nip formed between the vertical transport rollers 37. Accordingly, the controller 50 controls the drives of the pick-up roller 34 and the feed roller 35 of the pick-up-unit to stop. Consequently, the preceding sheet S1 is transported by the transport force generated solely by the vertical transport rollers 37 (Step S15).

As described above, the pick-up roller 34 and the feed roller 35 are each connected to the corresponding driver via a one-way clutch. Accordingly, after the stop of the drivers, the pick-up roller 34 and the feed roller 35 are rotated passively as the pair of vertical transport rollers 37 transport the preceding sheet S1. This allows the preceding sheet S1 to be transported smoothly.

Subsequently, a gap occurrence detection process is performed for detecting the occurrence of gap between the trailing edge of the preceding sheet S1 and the leading edge of the following sheet S2 (Step S16).

As described above, in order to properly control the sheet interval between the preceding sheet S1 and the following sheet S2, it is required to detect the timing at which the preceding sheet S1 and the following sheet S2 are separated from each other. The timing can be recognized by detecting the occurrence of a gap between the trailing edge of the preceding sheet S1 and the leading edge of the following sheet S2.

Figure 7:
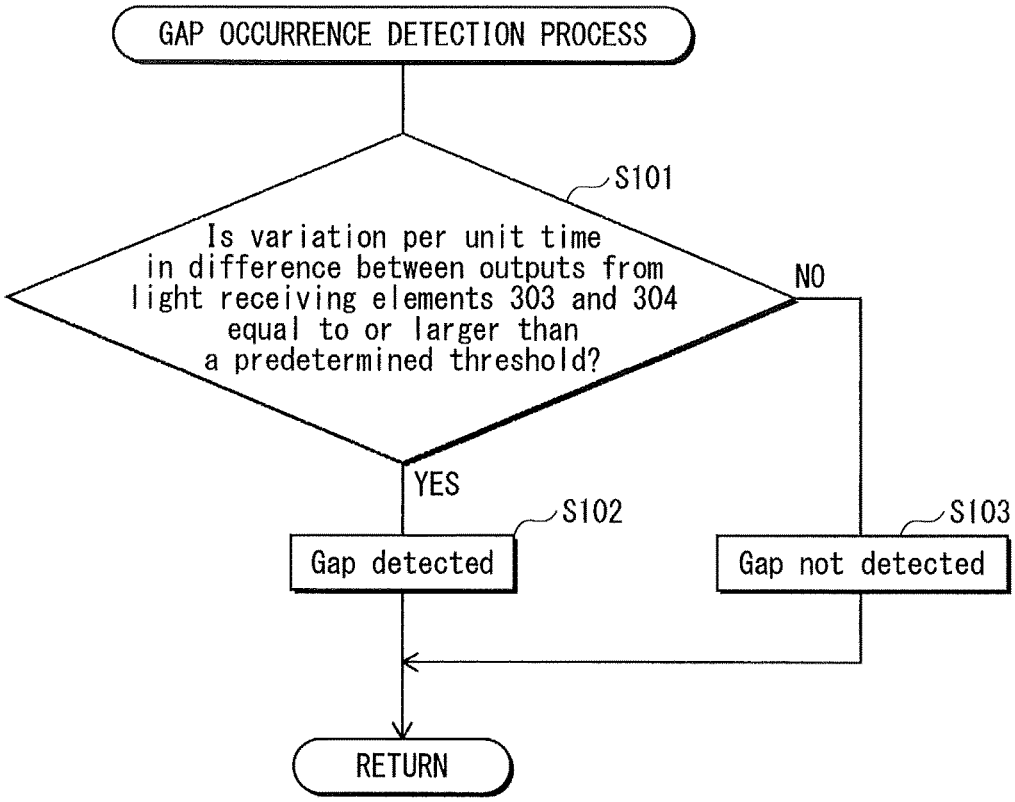
FIG. 7 is a flowchart of the gap occurrence detection, which is a sub-routine performing in Step S16 of the flowchart shown in FIG. 6.

FIG. 7 is a flowchart showing the operations performed in the sub-routine for the gap occurrence detection.

The CPU 51 monitors the difference between the output from the light receiving element 303 and that of the light receiving element 304 (i.e., the output from the difference calculation circuit 56: see FIG. 4), and judges whether or not the variation per unit time in the difference is equal to or larger than a predetermined threshold (Step S101).

If it is judged that the variation is equal to or larger than the predetermined threshold (Step S101: YES), it is regarded that a gap occurs (Step S102). If judged otherwise (Step S101: NO), it is regarded that a gap does not occurs (Step S103).

Here, referring back to the flowchart shown in FIG. 6, in Step S17, if the judgment made in the subroutine indicates that a gap does not occur (Step S17: NO), the controller 50 repeats Step S16 again. If the judgment made in the subroutine indicates that a gap occurs (Step S17: YES), the controller 50 judges whether or not the following sheet S2 is required to be fed (Step S18).

If judging that the following sheet S2 is required to be fed (Step S18: YES), after a predetermined time has elapsed (Step S19: YES), the controller 50 controls the pick-up roller 34 and the feed roller 35 of the pick-up unit to start feeding the following sheet S2 (Step S13).

For example, in the case that the system of the gap occurrence detection unit 300 guarantees the accuracy of the gap occurrence detection such that a gap g having a width of appropriately 5 mm can be detected, in order to control the interval between sheets to be 20 mm, the controller 50 may controls the pick-up roller 34 and the feed roller 35 of the pick-up unit to start after t seconds has elapsed from the gap occurrence detection. When the transport speed of the vertical transport roller 37 is V mm/s, t is given as follows:

$$t=[((20-5)/V)-\alpha]$$

where "α" denotes a time length determined by taking into consideration a delay time taken until the peripheral speed of the pick-up roller 34 and the feed roller 35 rises from 0 to V mm/s.

Note that, the judgment, in Step S18, on whether or not the following sheet S2 is required to be fed can be easily made, for example, by comparing the number of the document sheets read by the image reader unit A with the counted number of fed sheets (when in the copying operation) or, by comparing the number of pages described in the header of the received print job with the counted number of fed sheets (when in the printing operation).

When, it is judged, in Step S18, that the following sheet S2 is not required to be fed (Step S18: No), the controller 50 turns off the vertical transport sensor 201, and the gap occurrence detection unit 300 including the light emitting element 301 and the light receiving elements 303 and 304 in (Step S20). In parallel, after waiting until it is judged that the transport of the preceding sheet S1 is completed (i.e., the preceding sheet S1 is ejected by the ejection roller 39) (Step S21: YES), the controller 50 controls the vertical transport portion to stop (Step S22). The completion of the transport (i.e., ejection of the sheet) can be judged, for example, by using a paper feed sensor provided at the ejection roller 39.

Here, refer back to the main flowchart.

As described above, in the structure of the paper feed unit 30 of the copier according to the present embodiment, the gap occurrence detection unit 300 can certainly detect the occurrence of a gap by deducting the amount of light reflected by the recording sheets from the amount of light reflected by the converging reflector 302 of the light emitting element 301. Accordingly, the sheet interval is properly controlled such that productivity is increased.

In addition, no optical element other than the converging reflector 302 is required. This contributes to saving space. In addition, only one converging reflector 302 is used as an optical element. The number of light receiving elements is larger by one than in a conventional device. However, a light receiving element is far less expensive than an optical element. Consequently, entire cost can be reduced.

Embodiment 2

The copier pertaining to Embodiment 2 differs from that pertaining to Embodiment 1 mainly in the structure of the gap occurrence detection unit and the gap occurrence detection process. Accordingly, the following mainly describes the differences.

Figure 8:
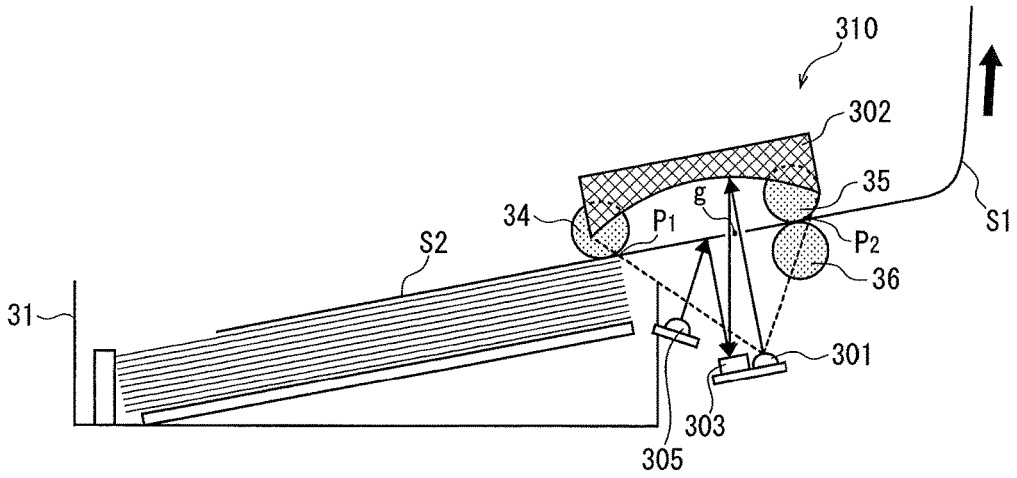
FIG. 8 shows the structure of a gap occurrence detection unit pertaining to Embodiment 2 of the present invention.

FIG. 8 shows major components of a gap occurrence detection unit 310 pertaining to the present embodiment. Note that the same numeral references as in FIG. 2 indicate the same components, and, therefore, the description thereof is omitted.

As shown in the figure, in the present embodiment, two light emitting elements 301 and 305 are provided for a single light receiving element 303.

Similar to FIG. 2, diffused light from the light emitting element 301 travels toward the converging reflector 302, and the converging reflector 302 converges the entering light onto the light receiving surface of the light receiving element 303. Accordingly, when a gap g occurs between the preceding sheet S1 and the following sheet S2, the amount of the light received by the light receiving element 303 varies in accordance with the width of the gap g.

The light emitting element 305 emits light (i.e., diffused light), from a position different from that of the light emitting element 301, toward the bottom major surface of a recording sheet transported along the sheet transport path. In the present embodiment, it is desirable that the light emitting element 305 is arranged such that a portion of the light, which is emitted by the light emitting element 305 in a direction orthogonal to the substrate on which the light emitting element 305 is disposed, is regularly reflected by a recording sheet and enters the light receiving element 303.

Similarly to the light emitting element 301, the light emitting element 305 is also designed to emit light having a predetermined diffusion angle. It is not required that even the diffusion angle of the diffused light is the same as that of the light emitting element 301. The light emitting element 305 is provided for the purpose of obtaining data for avoiding an error of the gap occurrence detection caused due to the light emitted by the light emitting element 301 and reflected by a recording sheet. Accordingly, it is preferable that the region of recording sheet irradiated by the light from the light emitting element 305 is as close as possible to that irradiated by the light from the light emitting element 301. It is also preferable that outputs from the light emitting elements 301 and 305 are the same.

Note that it suffices if the light emitting element 305 and the light emitting element 301 are located at different positions in terms of at least one of a sheet transport direction and a width direction of a sheet.

The reflection surface of the converging reflector 302 is optically designed such that light emitted from the position of the light emitting element 301 is converged onto the light receiving element 303. Accordingly, when no recording sheet is in the sheet transport path, light emitted by the light emitting element 305 from a position differing from that of the light emitting element 301 and reflected by the converging reflector 302 does not enter the light receiving element 303.

Consequently, when only the light emitting element 305 is lighting, the light receiving element 303 mainly receives reflection light from recording sheets (i.e., serves as a component of the second detection unit), and, when only the light emitting element 301 is lighting, the light receiving element 303 receives reflection light from the recording sheets and additional reflection light entering from the converging reflector 302 through the gap (i.e., serves as a component of the first detection unit). This allows for detection in two different ways based on the sampling value of the output from the light receiving element 303 obtained when the light emitting elements 301 is lighting and that obtained when the light emitting elements 305 is lighting.

Figure 9:
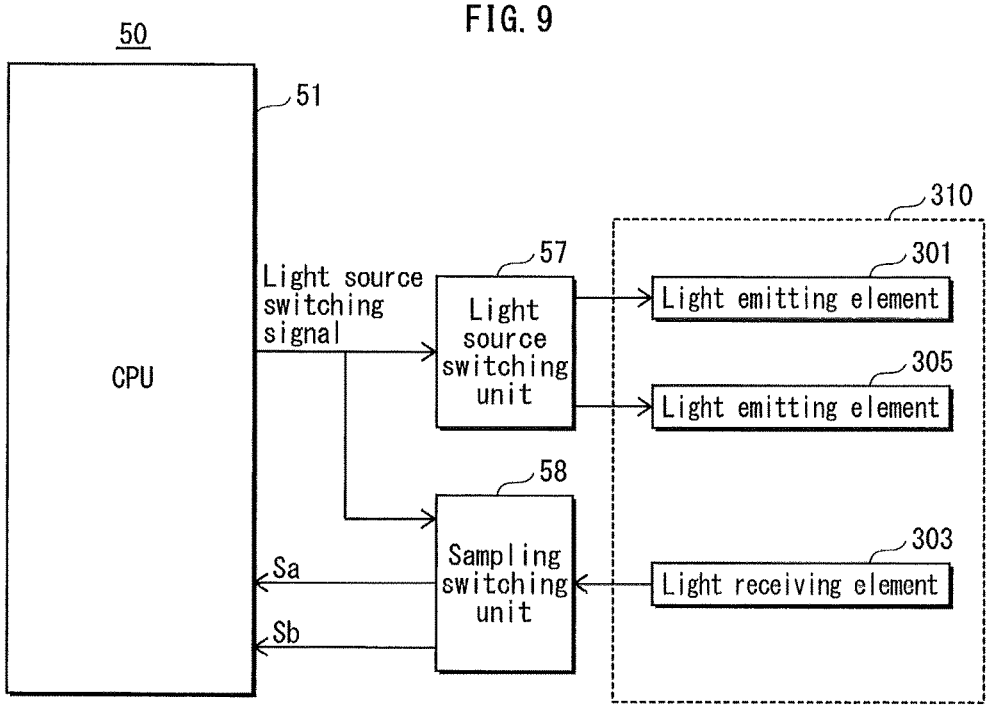
FIG. 9 shows the major components of a controller pertaining to Embodiment 2 of the present invention.

FIG. 9 shows characteristic components of the controller 50 in Embodiment 2.

Figure 10:
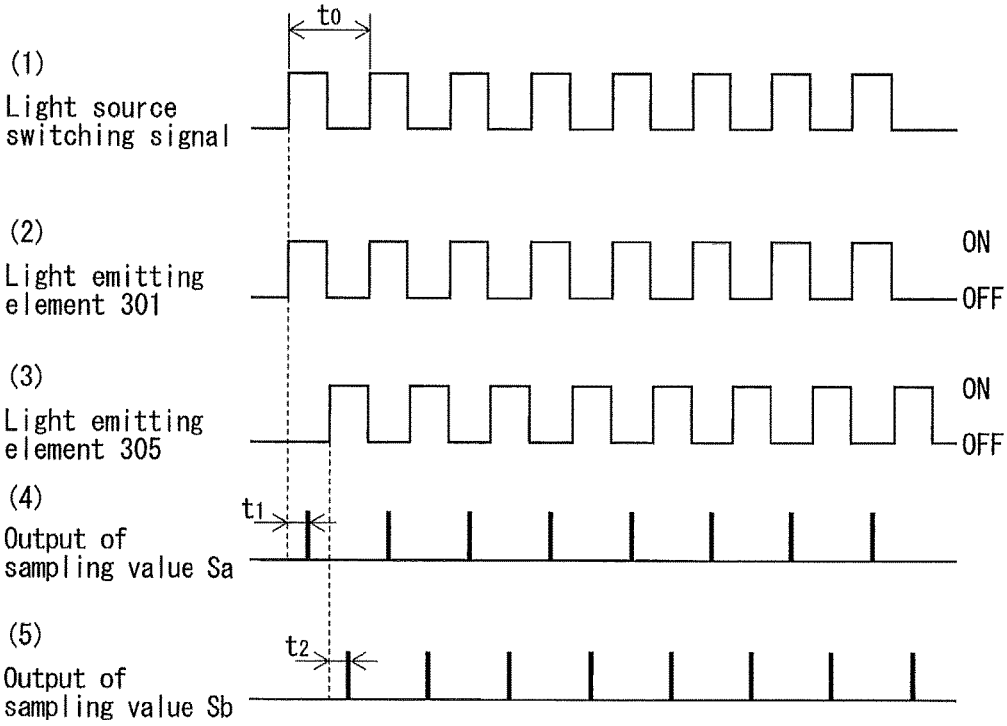
FIG. 10 is a time chart showing timings of lighting up of two light emitting elements and those of switching, performed by the controller, between sampling values that is output as a sampling output.

FIG. 10 is a time chart showing timings of lighting up of the light emitting elements 301 and 305 and those of switching the sampling output from the light receiving element.

The CPU 51 outputs pulse waves having a predetermined frequency to the light source switching unit 57 as a light source switching signal (see the section (1) in FIG. 10).

The light source switching unit 57 makes a switching such that power supply destination is changed to the light emitting element 301 at the rising edge of the light source switching signal from the CPU 51 (see the section (2) in FIG. 10), and to the light emitting element 305 at the falling edge of the light source switching signal (see the section (3) in FIG. 10).

Generally, it takes a response time of approximately 50 to 100 nsec either to turn on an LED at the rising edge or to turn off at the falling edge. In addition, with respect to a photodiode, it takes a response time of approximately 200 nsec.

Accordingly, in the present embodiment, the cycle t0 of the light source switching signal is set as 1 msec, taking into consideration a margin.

The light source switching signal is also applied to a sampling switching unit 58. The sampling switching unit 58 outputs, to the CPU 51, a sampling value Sa obtained by sampling the output from the light receiving element 303 after a predetermined time T1 has passed from the rising edge of the light source switching signal (tu<T1<t0/2, where tu indicates the time taken to turn on the LED in response to the rising edge) (see the section (4) in FIG. 10). Whereas, the sampling switching unit 58 outputs, to the CPU 51, a sampling value Sb obtained by sampling the output from the light receiving element 303 after a predetermined time t2 has passed from the falling edge of the light source switching signal (tu<t2<T/2) (see the section (5) in FIG. 10).

Figure 11:
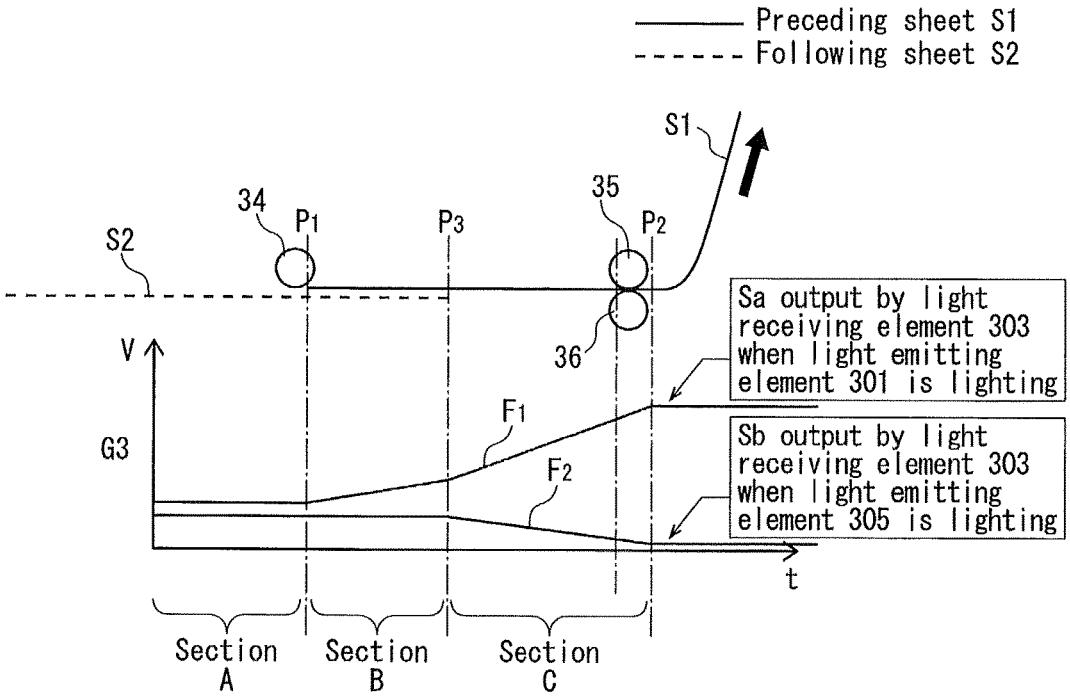
FIG. 11 shows variation over time in sampling values Sa and Sb output from the light receiving element 303 of the gap occurrence detection unit in Embodiment 2 in the case that a preceding sheet S1 and a following sheet S2 are picked up together at a time and the following sheet S2 stops at a position P3.

FIG. 11 shows a graph G3 in which the variations in the output values Sa and Sb obtained by the above-described sampling process is shown in correlation with the positions of the preceding sheet S1 and the following sheet S2 within the pick-up unit of the paper feed unit 30.

The broken lines F1 and F2 correspond to the broken lines E1 and E2 shown in FIG. 3 relating to Embodiment 1, respectively.

In the gap occurrence detection pertaining to the present embodiment, gap occurrence may be detected, similarly to Embodiment 1, based on whether or not the rate of variation per unit time (i.e., inclination) of the difference between the values represented by the broken lines F1 and F2 reaches or exceeds a predetermined threshold. However, in the present embodiment, gap occurrence is detected based on the fact that, at the separation position P3, the broken line F1 goes up while the broken line F2 goes down.

Figure 12:
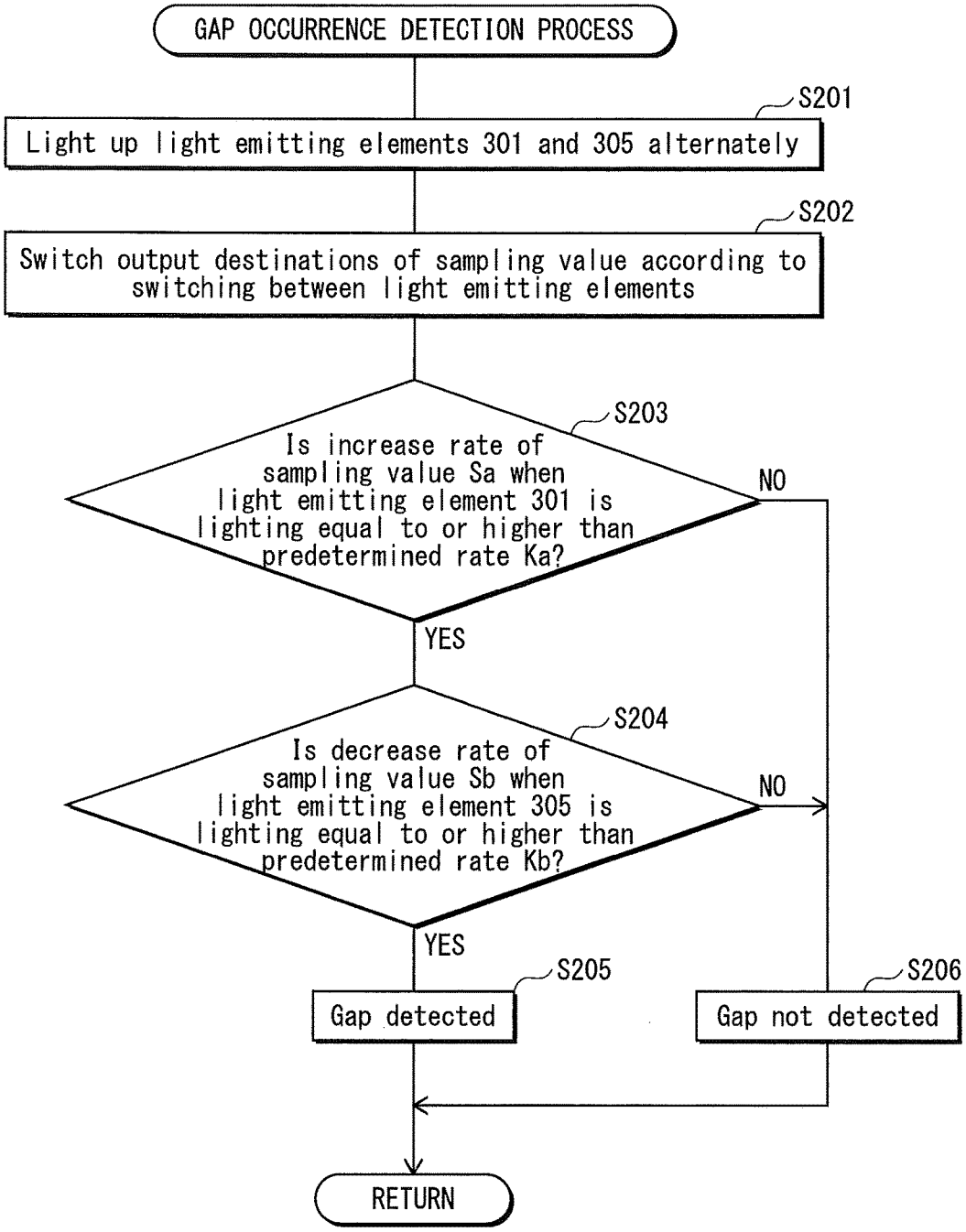
FIG. 12 is a flowchart of a subroutine for performing the gap occurrence detection pertaining to Embodiment 2.

FIG. 12 is a flowchart of a subroutine for performing the gap occurrence detection process pertaining to the present embodiment.

To start with, the CPU 51 transmits the light source switching signal to the light source switching unit 57. According to the light source switching signal, the light source switching unit 57 alternately lights up the light emitting elements 301 and 305 (Step S201).

Depending on the light emitting element lit up in Step S201, the CPU 51 controls the sampling switching unit 58 to determine whether the sampling value from the light receiving element 303 is output as the sampling value Sa or the sampling value Sb (Step S202).

The CPU 51 stores the sampling value as the sampling value Sa when the light emitting element 301 is lighting and as the sampling value Sb when the light emitting element 305 in the RAM 53 or the nonvolatile memory 55. Subsequently, the CPU 51 judges whether or not the sampling value Sa obtained while the light emitting element 301 is lighting has increased at a rate equal to or higher than a predetermined rate Ka (Step S203).

When the sampling value Sa has increased at a rate equal to or higher than the predetermined rate Ka (Step S203: YES), the CPU 51 subsequently judges whether or not the sampling value Sb obtained while the light emitting element 305 is lighting has decreased at a rate equal to or higher than a predetermined rate Kb (Step S204).

When the sampling value Sb has decreased at a rate equal to or higher than the predetermined rate Kb, the CPU 51 determines that a gap was detected (Step S205). When judged negatively in any of Steps S203 and S204, the CPU 51 determines that a gap was not detected (Step S206).

Here, referring again to the flowchart shown in FIG. 6.

As described above, in the present embodiment, gap occurrence is detected by referring to two detection results Sa and Sb obtained by the single light receiving element 303 using two different light sources. When the two detection results Sa and Sb each satisfy a predetermined condition, it is judged that a gap has occurred. This improves the accuracy of the gap occurrence detection, thereby achieving sheet feed control with higher productivity.

Note that the predetermined rates Ka and Kb may be required to be adjusted based on the characteristics varying depending on the type of the recording sheet S (e.g., smoothness and color of the surface thereof). Accordingly, the CPU 51 may prepare candidates of the rates Ka and Kb each corresponding to any type of a recording sheet S, and selects one of the candidates based on the information, received from the user via the operation panel 60, that indicates the type of the recording sheet S.

Embodiment 3

The copier pertaining to Embodiment 3 is different from those pertaining to Embodiments 1 and 2, mainly in the structure of the gap occurrence detection unit. Accordingly, the following mainly describes the difference.

Figure 13A:
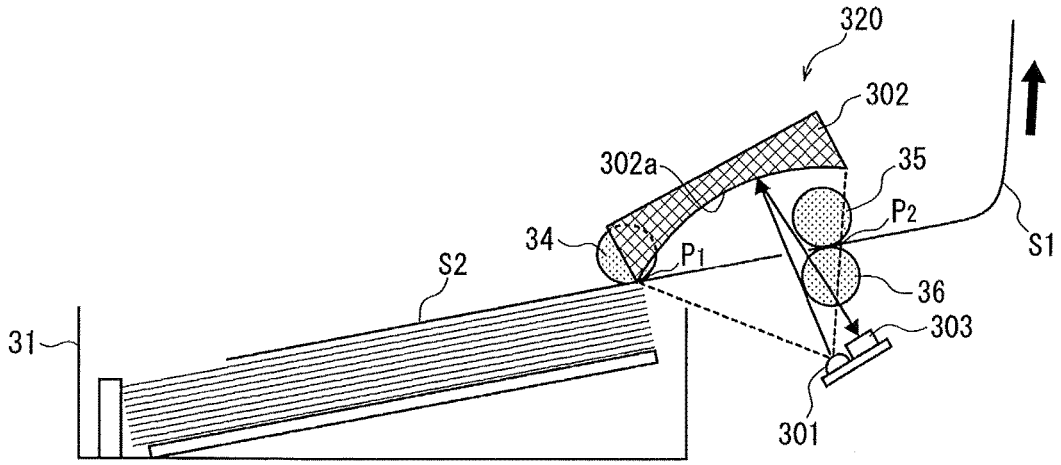
FIG. 13A shows major components of a gap occurrence detection unit in Embodiment 3.

FIG. 13A shows major components of a gap occurrence detection unit 320 pertaining to the present embodiment. Note that the same numeral references as in FIG. 2 indicate the same components, and, therefore, the detailed description thereof is omitted.

The gap occurrence detection unit 320 in the present embodiment includes a light emitting element 301, a light receiving element 303, and a converging reflector 302.

Diffusion light emitted by the light emitting element 301 enters the reflection surface 302*a* of the converging reflector 302 after travelling across a section of the transport path which is not covered by the recording sheet, and, subsequently, is reflected by the converging reflector 302 to be converged onto the light receiving surface of the light receiving element 303. Similarly to Embodiment 1, the positional relation among the light emitting element 301, the light receiving element 303, and the converging reflector 302 is determined such that portions of the diffusion light entering the upstream edge and the downstream edge of the reflection surface 302*a* of the converging reflector 302 travel through the positions P1 and P2 along the transport path, respectively. However, in the present embodiment, the light receiving element 303 is positioned downstream from the light emitting element 301, and the entire gap occurrence detection unit 320 is arranged to be slightly tilted relative to the sheet transport surface of the sheet transport path. This arrangement prevents the regular reflection light that is emitted by the light emitting element 301 and reflected by a recording sheet from entering the light receiving surface of the light receiving element 303.

Figure 13B:
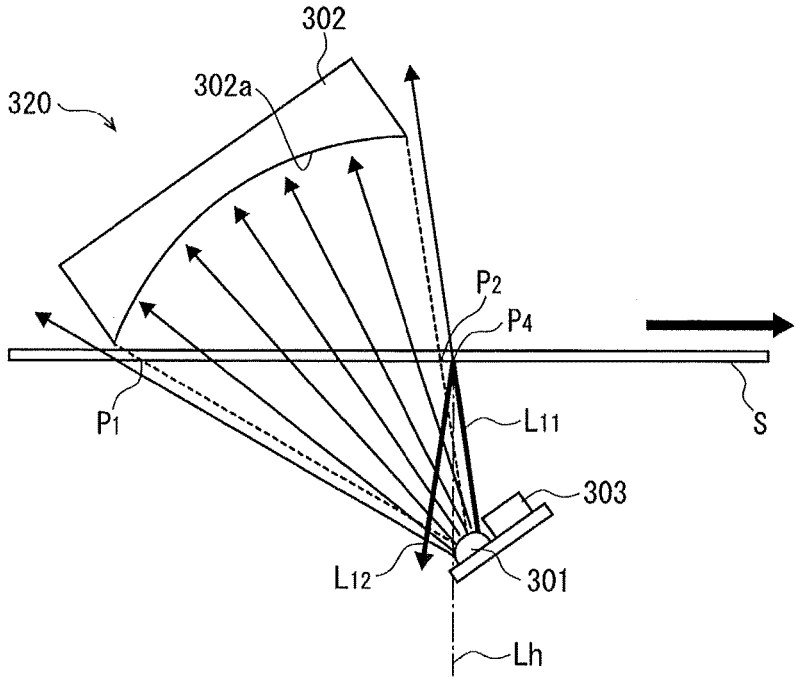
FIG. 13B shows the positional relation between the components of the gap occurrence detection unit shown in FIG. 13A and a transport path of a recording sheet.

FIG. 13B is an enlarged partial view of the gap occurrence detection unit 32 showing the position thereof relative to a recording sheet S transported along the sheet transport path.

Among light rays of the regular reflection light that is emitted by the light emitting element 301 as diffused light and reflected by the recording sheet S, the light ray L12, which has traveled through the most downstream side as the light ray L11 and, is subsequently reflected by the bottom surface of the recording sheet S at the position P4, is mostly liable to enter the light receiving element 303 (note that the dashed line Lh represents the normal vector of the bottom surface of the recording sheet S at the position P4). However, in the present embodiment, in order to prevent the light ray L12 from entering the light-receiving surface of the light receiving element 303, the entire gap occurrence detection unit 320 is arranged to be tilted relative to the sheet transport path T1 as shown in FIG. 13B. Consequently, regular reflection light reflected by the bottom surface of the recording sheet S does not enter the light receiving element 303 at all.

Since the reflection light from the recording sheet includes irregular reflection light, it is difficult to prevent the entire reflection light from the recording sheet from entering the light receiving element 303, even if the above-described configuration is employed. However, the configuration allows for preventing the regular reflection light that is considered to have higher light intensity than the irregular reflection light from entering the light receiving element 303. Accordingly, the configuration guarantees the influence of the reflection light from the recording sheet on the gap occurrence detection is eliminated to a certain extent, thereby improving the reliability of the gap occurrence detection.

Figure 14:
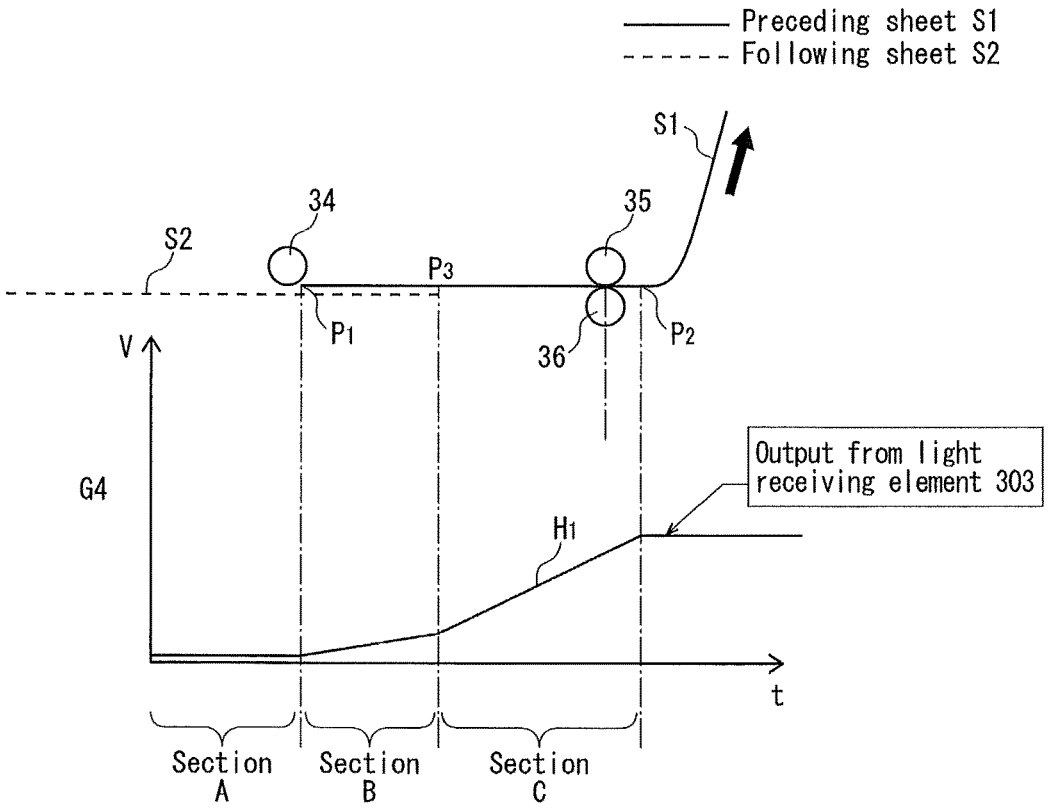
FIG. 14 shows variation over time in the output from a light receiving element 303 of the gap occurrence detection unit in Embodiment 3 in the case that a preceding sheet S1 and a following sheet S2 are picked up together at a time and the following sheet S2 stops at a position P3.

Graph G4 in FIG. 14 shows the variation in the output from the light receiving element 303 in the present embodiment in correlation with the position of a recording sheet within the pick-up unit.

The broken line H1 in the figure indicates the variation in the output from the light receiving element 303. In comparison with the broken line E1 shown in FIG. 3 relating to Embodiment 1 and the broken line F1 shown in FIG. 10 relating to Embodiment 2, the output indicated by the broken line H1 is small in the sections A and B because the received amount of the reflection light from the recording sheet is small, and, in the section C after the occurrence of a gap, the amount of the reflection light reflected by the converging reflector 302 and received through the gap increases, as the gap gradually widens, at a rate higher than the sections A and B. Accordingly, the gap occurrence is detected easily.

Note that, in the present embodiment, an additional unit (i.e., an irregular reflection light reduction unit) may be provided for reducing the amount of light that enters the light receiving element 303 from the light emitting element 301, and is reflected by a recording sheet.

Figure 15:
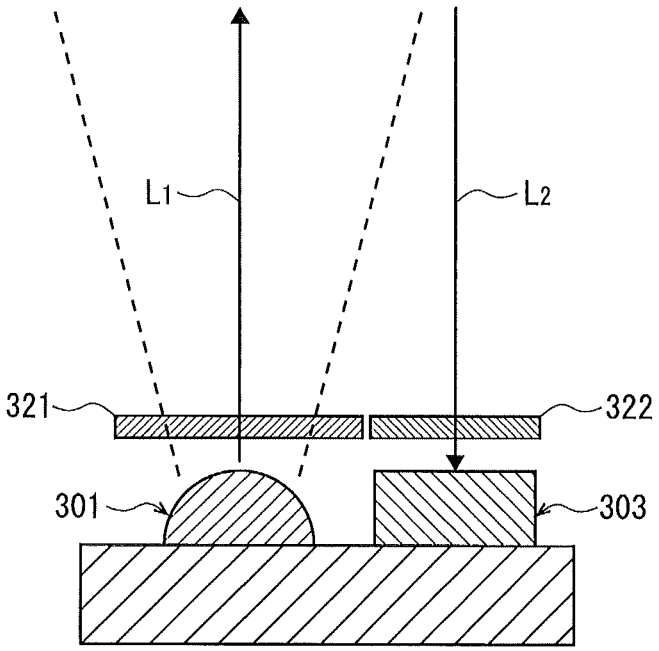
FIG. 15 shows polarizing filters provided over a light-emitting surface of the light emitting element and a light-receiving surface of the light receiving element in Embodiment 3.

FIG. 15 is a schematic view showing an example of the configuration including the irregular reflection light reduction unit.

As shown in the figure, a first polarizing filter 321 is disposed in front of the light emitting element 301 in the light emitting direction, and a second polarizing filter 322 is disposed in front of the light receiving surface of the light receiving element 303.

The first and second polarizing filters 321 and 322 each comprise a linearly polarizing plate, and are held at the above-mentioned positions by a holder that is not shown.

The light from the light emitting element 301 passes through the first polarizing filter 321 to be converted into linearly polarized light. When regularly reflected (i.e., mirror-reflected) by the mirror surface, most portion of the linearly polarized light is reflected as linearly polarized light. In contrast, when the linearly polarized light is reflected by a rough surface (e.g., a surface of a recording sheet), portions thereof are irregular light (i.e., scattered light) that are polarized in various directions and, when gathered, it is no longer polarized light.

Accordingly, in the present embodiment, the second polarizing filter 322 is disposed in front of the light receiving element 303 such that the polarization axis of the second polarizing filter 322 is aligned with the polarization axis of the linearly polarized light reflected by the converging reflector 302. This arrangement blocks the irregular reflection light from the recording sheet, while transmitting the regular reflection light from the converging reflector 302, thereby achieving more precise gap occurrence detection.

Modifications

In the above, the description has been provided on the present invention based on specific embodiments thereof. However, the present invention should not be limited to such embodiments. For example, the following modifications may be applied.

(1) The positional relation between the light emitting element and the light receiving element is not limited to those in the above-described embodiments.

Figure 16A:
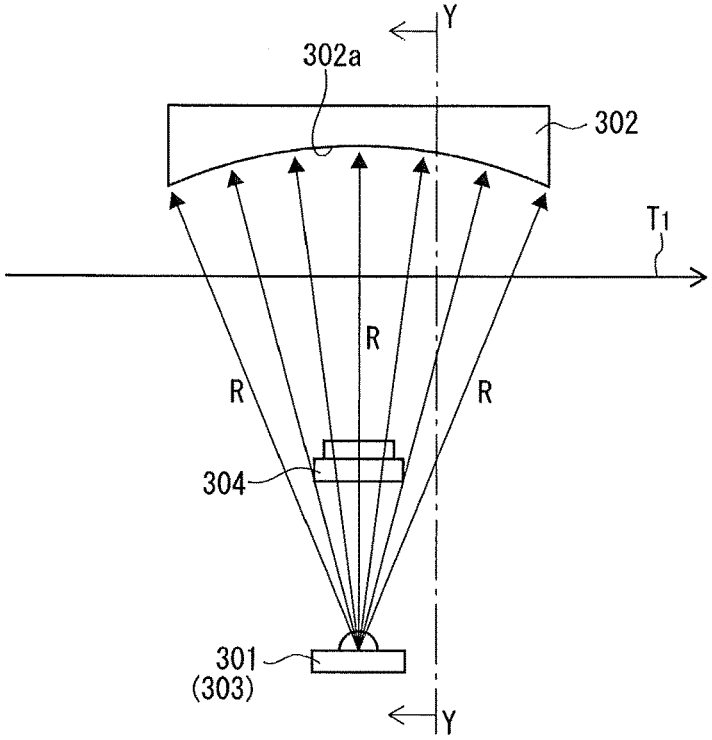
FIG. 16A and FIG. 16B each show a variation of the arrangement of the light emitting element, light receiving element, converging reflector, and so on in the gap occurrence detection unit according to Embodiment 1.

For example, the arrangement in Embodiment 1 may be modified such that, as shown in FIG. 16A, the reflection surface 302*a* forms a portion of a cylindrical surface having a radius R, and the light emitting point of the light emitting element 301 is located on the center axis of the cylinder including the cylindrical surface.

Figure 16B:
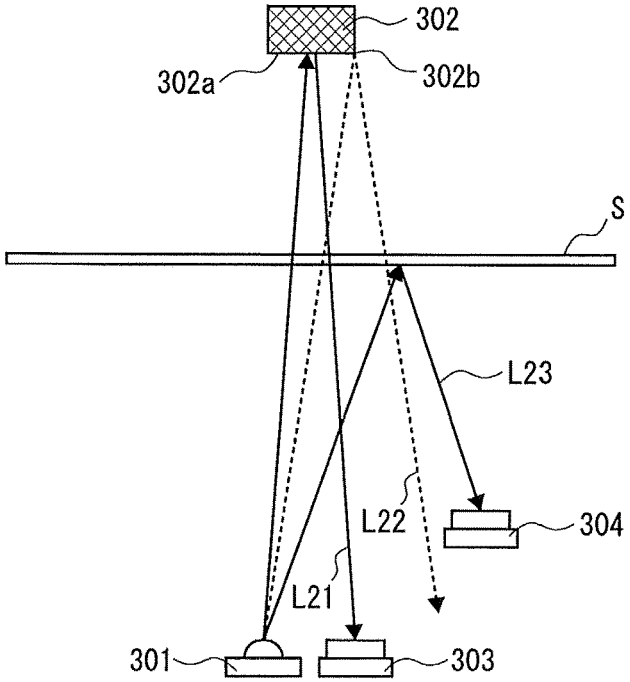

FIG. 16B is a schematic cross-sectional view along the line Y-Y in FIG. 16A. In FIG. 16B, the light emitted by the light emitting element 301 obliquely enters the reflection surface 302*a* of the converging reflector 302. The light receiving element 303 is arranged such that the receiving surface thereof is located on the center axis of the cylinder including the reflection surface 302*a*, and receives the regular reflection light L21 which is emitted by the light emitting element 301 and reflected by the converging reflector 302 enters.

Whereas, the light receiving element 304 is located at a position where the light emitted by the light emitting element 301 and reflected by the bottom surface of a recording sheet S transported along the sheet transport path T1 (i.e., the reflection light L23) enters, but the light emitted by the light emitting element 301 and reflected by the converging reflector 302 (i.e., the regular reflection light L22) does not enter.

Not that, if acceptable from a viewpoint of design, the converging reflector 302 may be disposed below the sheet transport path T1, and the light emitting element 301, and the light receiving elements 303 and 304 may be disposed above the sheet transport path T1.

In addition, as long as a required detection area is secured in the sheet transport direction, the longitudinal direction of the light receiving element 303 does not necessarily match the sheet transport direction.

(2) In the above-mentioned Embodiment 1, two light receiving elements 303 and 304 are provided for a single light source (i.e., the light emitting element 301). The light receiving elements 303 is located at a position where the regular reflection light from the converging reflector 302 enters (hereinafter, the light receiving elements 303 and the converging reflector 302 arranged as above are referred to as a "first detection unit"). Whereas, the light receiving element 304 is located at a position where the regular reflection light emitted by the light emitting element 301 and reflected by the converging reflector 302 does not enter, but the reflection light emitted by the light emitting element 301 and reflected by the recording sheet on the sheet transport path within the paper feed unit enters (hereinafter, the light receiving elements 304 and the converging reflector 302 arranged as above are referred to as a "second detection unit").

Figure 17A:
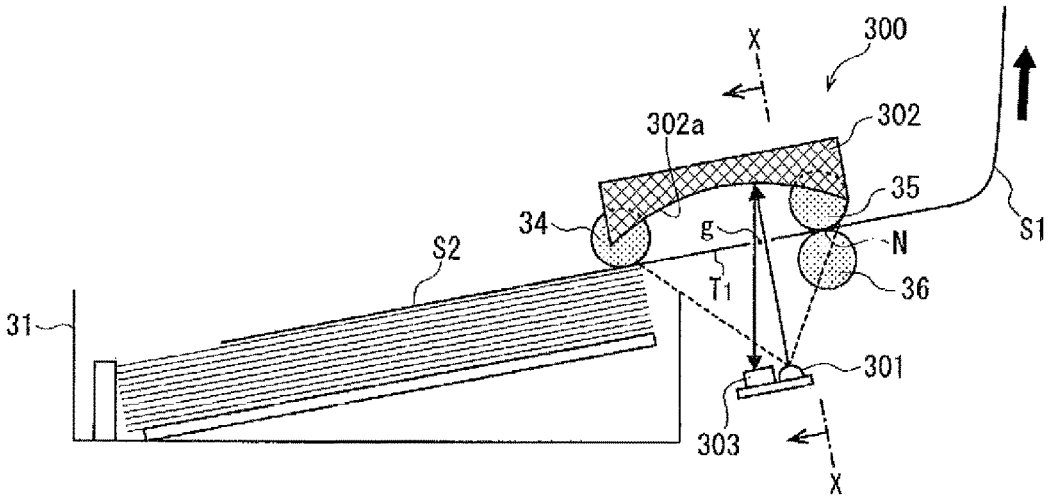
FIG. 17A and FIG. 17B each show another variation of the arrangement of the light emitting element, light receiving element, converging reflector, and so on in the gap occurrence detection unit according to Embodiment 1.
Figure 17B:
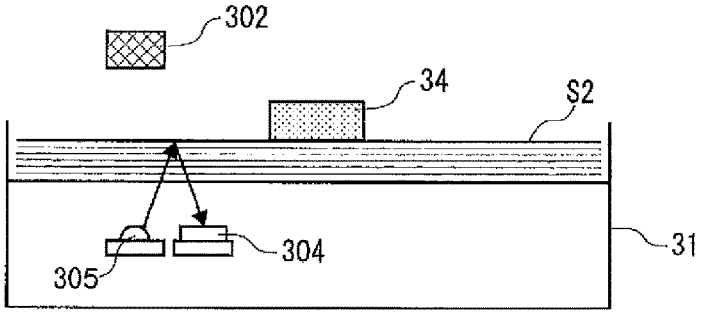

The single light emitting element 301 configured to serve as a light source for two detection units naturally contributes to cost saving. In addition, light emitting elements are generally far less expensive than optical elements such as a light converging plate, and small in size. However, if necessary, a dedicated light emitting element may be provided for each of the first and second detection unit. FIGS. 17A and 17B illustrate a modification to Embodiment 1 in which a second light emitting element 305 serves as the second light source.

In the case that the first and second detection units are each provided with a dedicated light emitting element and light receiving element, similarly to those in Embodiment 2, the light emitting elements are alternately lit up and the light receiving element included in the same detection unit as the lit-up light emitting element is selected to perform sampling, such that each detection unit may not be influenced by the irradiation light from the light emitting element included in the other detection unit.

In addition, instead of switching the light emitting element to be lit up and selecting light receiving element performing the sampling, the first detection unit and the second detection unit may use dedicated detection light different in the wavelength region. For example, an optical filter that transmits light having a first wavelength is located at a suitable position on each of the light emitting surface of the light emitting element and the light receiving surface of the light receiving element of the first detection unit. Similarly, an optical filter that transmits light having a second wavelength is located at a suitable position on each of the light emitting surface of the light emitting element and the light receiving surface of the light receiving element of the second detection unit. This arrangement excludes the influence of light emitted from one of the detection units on the other, and, consequently, allows more accurate gap occurrence detection.

(3) In Embodiment 1, the influence of the reflection light from a recording sheet on the light emitting element 301 is avoided by calculating difference between the detection value PD1 from the light receiving element 303 and the detection value PD2 from the light receiving element 304. From this standpoint, it is expected that the accuracy of the gap occurrence detection is improved by arranging the light receiving elements 303 and 304 so as to receive as close an amount of reflection light as possible from the recording sheet.

Accordingly, it is desirable that the light receiving elements 303 and 304 are arranged to be at the same distance from a recording sheet on the transport path and at the same position in the sheet transport direction.

The detection value PD2 from the light receiving element 304 may be multiplied by a predetermined correction factor before the difference is calculated between the detection value PD1 from the light receiving element 303 and the detection value PD2. The correction factor may be obtained, for example, by (i) obtaining the amount of received reflection light from the recording sheet, with respect to each of the light receiving elements 303 and 304, when the recording sheet completely covers the section of the sheet transport path within the detection area of the gap occurrence detection unit 300, and (ii) calculating the ratio of the obtained amounts as k:1. The detection value PD2 from the light receiving element 304 is corrected by the multiplication by the correction factor k. After the correction, the difference is calculated by subtracting the corrected detection value PD2 from the detection value PD1 from the light receiving element 303.

(4) In the above-described embodiments, as shown in FIG. 3 for example, the gap occurrence detection area of the gap occurrence detection unit is defined as the section of the sheet transport path from the position P1 immediately downstream of the pick-up roller 34 to the position P2 immediately downstream of the separation nip N formed between the feed roller 35 and the separation roller 36. The detection area may be defined differently. Any section of the sheet transport path may be defined as the detection area insofar as a gap may probably occurs within the section as a result of separation of sheets picked up together at a time.

(5) Description of the embodiments has been made with reference to examples in which the present invention is applied to a paper feed unit of a tandem type color copier. However, the present invention is applicable to any image forming apparatus in which sheets are transported (e.g., a facsimile apparatus, and an apparatus dedicated for printing). Furthermore, the present invention is also applicable to either a color image forming apparatus or a monochrome image forming apparatus.

As described above with respect to Embodiment 1, the pick-up unit in the document transport unit 11 has a configuration similar to that of the paper feed unit 30. Accordingly, the sheet feeder pertaining to the present invention may be applied to the document transport unit in the document reader (i.e., image reader).

In summary, the present invention is applicable to any apparatus provided with a sheet feeder which may pick up multiple sheets together at a time.

The embodiments and modifications described above may be suitably combined.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A sheet feeder for sequentially picking up sheets from a sheet stack and continuously transporting the sheets along a sheet transport path, the sheet feeder comprising:

a transport unit that transports the sheets along the sheet transport path one by one;

a gap occurrence detection unit that detects, within a predetermined section of the sheet transport path, occurrence of a gap between the trailing edge of a preceding sheet and the leading edge of a following sheet; and a controller that controls a timing at which the transport unit starts transporting the following sheet according to a result of the detection by the gap occurrence detection unit, the gap occurrence detection unit including a first detection unit and a second detection unit, the first detection unit including:

a first light emitting element that is disposed on a first side of the sheet transport path and emits diffused light at least toward the predetermined section;

a first light receiving element that is disposed on the first side of the sheet transport path; and a converging reflector that is disposed on a second side of the sheet transport path opposite the first side and converges, onto the first light receiving element, light that is emitted by the first light emitting element and reaches the converging reflector by travelling across the predetermined section, and the second detection unit including:

a second light emitting element; and a second light receiving element that is located in a position to detect light from the second light emitting element that is reflected by a sheet passing through the predetermined section, wherein the gap occurrence detection unit detects occurrence of the gap based on an algorithm which uses both a first output from the first detection unit based on light that has been reflected by the converging reflector and is received by the first detection unit and on light that has been reflected by at least one sheet and is received by the first detection unit, and a second output from the second detection unit based on light that has been reflected by at least one sheet and is received by the second detection unit while the preceding sheet and the following sheet are passing through the predetermined section.

2. The sheet feeder according to claim 1, wherein the gap occurrence detection unit includes a difference calculation unit that calculates a difference between the amount of received light detected by the first detection unit and the amount of received light detected by the second detection unit, and detects occurrence of the gap based on an output from the difference calculation unit.

3. The sheet feeder according to claim 1, wherein the gap occurrence detection unit detects occurrence of the gap based on a rate of increase of the amount of the received light detected by the first detection unit and a rate of decrease of the amount of the received light detected by the second detection unit.

4. A document reader including, as a document feeder, the sheet feeder according to claim 1.

5. An image forming apparatus including, as a recording sheet feeder, the sheet feeder according to claim 1.

6. The sheet feeder according to claim 1, wherein the gap occurrence detection unit i) calculates a difference between an amount of received light detected by the first detection unit and an amount of received light detected by the second detection unit while the preceding sheet and the following sheet are passing through the predetermined section and ii) detects occurrence of the gap when a variation per unit time in the difference is equal to or larger than a predetermined threshold.

7. The sheet feeder according to claim 1, wherein the gap occurrence detection unit i) determines a rate of increase of an amount of received light detected by the first detection unit and a rate of decrease of an amount of received light detected by the second detection unit while the preceding sheet and the following sheet are passing through the predetermined section and the first and second light emitting elements are lit up alternately and ii) detects occurrence of the gap when the rate of increase of the amount of the received light detected by the first detection unit is greater than or equal to a first predetermined threshold and the rate of decrease of the amount of the received light detected by the second detection unit is greater than or equal to a second predetermined threshold.

8. The sheet feeder according to claim 1, wherein the second light emitting element is disposed on the same side of the sheet transport path as the second light receiving element.

9. The sheet feeder according to claim 1, wherein the second light emitting element and the second light receiving element are both disposed on the first side of the sheet transport path.

10. A sheet feeder for sequentially picking up sheets from a sheet stack and continuously transporting the sheets along a sheet transport path, the sheet feeder comprising:

a transport unit that transports the sheets along the sheet transport path one by one;

a gap occurrence detection unit that detects, within a predetermined section of the sheet transport path, occurrence of a gap between the trailing edge of a preceding sheet and the leading edge of a following sheet; and a controller that controls a timing at which the transport unit starts transporting the following sheet according to a result of the detection by the gap occurrence detection unit, the gap occurrence detection unit including a first detection unit and a second detection unit, the first detection unit including:

a first light emitting element that is disposed on a first side of the sheet transport path and emits diffused light at least toward the predetermined section;

a first light receiving element that is disposed on the first side of the sheet transport path; and a converging reflector that is disposed on a second side of the sheet transport path opposite the first side and converges, onto the first light receiving element, light that is emitted by the first light emitting element and reaches the converging reflector by travelling across the predetermined section, and the second detection unit including:

a second light emitting element; and a second light receiving element that is located in a position to detect light from the second light emitting element that is reflected by a sheet passing through the predetermined section, wherein the gap occurrence detection unit i) calculates a difference between an amount of received light detected by the first detection unit and an amount of received light detected by the second detection unit while the preceding sheet and the following sheet are passing through the predetermined section and ii) detects occurrence of the gap when a variation per unit time in the difference is equal to or larger than a predetermined threshold.

11. A sheet feeder for sequentially picking up sheets from a sheet stack and continuously transporting the sheets along a sheet transport path, the sheet feeder comprising:

a transport unit that transports the sheets along the sheet transport path one by one;

a gap occurrence detection unit that detects, within a predetermined section of the sheet transport path, occurrence of a gap between the trailing edge of a preceding sheet and the leading edge of a following sheet; and a controller that controls a timing at which the transport unit starts transporting the following sheet according to a result of the detection by the gap occurrence detection unit, the gap occurrence detection unit including a first detection unit and a second detection unit, the first detection unit including:

a first light emitting element that is disposed on a first side of the sheet transport path and emits diffused light at least toward the predetermined section;

a first light receiving element that is disposed on the first side of the sheet transport path; and a converging reflector that is disposed on a second side of the sheet transport path opposite the first side and converges, onto the first light receiving element, light that is emitted by the first light emitting element and reaches the converging reflector by travelling across the predetermined section, and the second detection unit including:

a second light emitting element; and a second light receiving element that is located in a position to detect light from the second light emitting element that is reflected by a sheet passing through the predetermined section, wherein the gap occurrence detection unit i) determines a rate of increase of an amount of received light detected by the first detection unit and a rate of decrease of an amount of received light detected by the second detection unit while the preceding sheet and the following sheet are passing through the predetermined section and the first and second light emitting elements are lit up alternately and ii) detects occurrence of the gap when the rate of increase of the amount of the received light detected by the first detection unit is greater than or equal to a first predetermined threshold and the rate of decrease of the amount of the received light detected by the second detection unit is greater than or equal to a second predetermined threshold.

* * * * *